US011434715B2

(12) United States Patent
Harris et al.

(10) Patent No.: US 11,434,715 B2
(45) Date of Patent: Sep. 6, 2022

(54) FRAC PLUG WITH COLLAPSIBLE PLUG BODY HAVING INTEGRAL WEDGE AND SLIP ELEMENTS

(71) Applicant: Lonestar Completion Tools, LLC, Brenham, TX (US)

(72) Inventors: Michael J. Harris, Houston, TX (US); Kenneth J. Anton, Brenham, TX (US)

(73) Assignee: Lonestar Completion Tools, LLC, Brenham, TX (US)

( * ) Notice: Subject to any disclaimer, the term of this patent is extended or adjusted under 35 U.S.C. 154(b) by 0 days.

(21) Appl. No.: 17/390,496

(22) Filed: Jul. 30, 2021

(65) Prior Publication Data

US 2022/0034192 A1 Feb. 3, 2022

Related U.S. Application Data

(60) Provisional application No. 63/060,043, filed on Aug. 1, 2020.

(51) Int. Cl.

| | |
|---|---|
| ***E21B 23/01*** | (2006.01) |
| ***E21B 33/128*** | (2006.01) |
| ***E21B 33/129*** | (2006.01) |
| ***E21B 33/12*** | (2006.01) |
| *E21B 43/26* | (2006.01) |

(52) U.S. Cl.
CPC ..... *E21B 33/1291* (2013.01); *E21B 33/1208* (2013.01); *E21B 43/26* (2013.01)

(58) Field of Classification Search
CPC ..... E21B 23/01; E21B 23/06; E21B 33/10; E21B 33/12; E21B 33/1204; E21B 33/1208; E21B 33/128; E21B 33/1285; E21B 33/129; E21B 33/1291; E21B 33/1292; E21B 33/1293; E21B 33/1295
See application file for complete search history.

(56) References Cited

U.S. PATENT DOCUMENTS 3,109,493 A * 11/1963 Carter ..... E21B 33/12 277/337
3,602,305 A * 8/1971 Kisling, III ..... E21B 23/06 166/134
4,901,794 A 2/1990 Baugh et al.
(Continued)

FOREIGN PATENT DOCUMENTS

EP 1712729 A2 10/2006
WO 2015/171126 A1 11/2015

OTHER PUBLICATIONS

American Completion Tools, *Hydraulic Setting Tool* p. 19 (undated).
(Continued)

*Primary Examiner* — Kenneth L Thompson
(74) *Attorney, Agent, or Firm* — Keith B. Willhelm

(57) ABSTRACT

A frac plug apparatus has a plug body that comprises a central bore and separable elements. The central bore extends axially through the plug body. The separable elements are joined by relatively weak bridging portions adapted to break in a controlled manner, the separable elements thereby forming an integral component comprised of the separable elements. The separable elements comprise a wedge element and an array of slip elements. The slip elements are joined to the wedge element by first bridging portions.

43 Claims, 25 Drawing Sheets

(56) References Cited

U.S. PATENT DOCUMENTS

| | | | | |
|---|---|---|---|---|
| 5,058,672 | A | 10/1991 | Cochran | |
| 5,058,684 | A | 10/1991 | Winslow et al. | |
| 5,271,468 | A | 12/1993 | Streich et al. | |
| 5,511,620 | A | 4/1996 | Baugh et al. | |
| 5,984,007 | A | 11/1999 | Yuan et al. | |
| 6,220,349 | B1 | 4/2001 | Vargus et al. | |
| 6,394,180 | B1 | 5/2002 | Berscheidt et al. | |
| 6,491,116 | B2 | 12/2002 | Berscheidt et al. | |
| 7,475,736 | B2 | 1/2009 | Lehr et al. | |
| 7,600,572 | B2 | 10/2009 | Slup et al. | |
| 7,740,079 | B2 | 6/2010 | Clayton et al. | |
| 7,789,137 | B2 | 9/2010 | Turley et al. | |
| 8,047,280 | B2 | 11/2011 | Tran et al. | |
| 8,066,065 | B2 * | 11/2011 | Buckner | E21B 33/1293 166/118 |
| 8,336,616 | B1 | 12/2012 | McClinton | |
| 8,469,088 | B2 | 6/2013 | Shkurti et al. | |
| 8,579,024 | B2 | 11/2013 | Mailand et al. | |
| 8,887,818 | B1 | 11/2014 | Carr et al. | |
| 8,950,504 | B2 | 2/2015 | Xu et al. | |
| 8,955,605 | B2 | 2/2015 | VanLue | |
| 8,985,228 | B2 | 3/2015 | Xu et al. | |
| 8,997,853 | B2 | 4/2015 | VanLue | |
| 9,010,411 | B1 | 4/2015 | VanLue | |
| 9,010,416 | B2 | 4/2015 | Xu et al. | |
| 9,033,060 | B2 | 5/2015 | Xu et al. | |
| 9,074,439 | B2 | 7/2015 | VanLue | |
| 9,080,403 | B2 | 7/2015 | Xu et al. | |
| 9,080,416 | B2 | 7/2015 | Xu et al. | |
| 9,080,439 | B2 | 7/2015 | O'Malley et al. | |
| 9,097,095 | B2 | 8/2015 | VanLue | |
| 9,103,177 | B2 | 8/2015 | VanLue | |
| 9,121,247 | B2 | 9/2015 | George et al. | |
| 9,121,252 | B2 | 9/2015 | George et al. | |
| 9,273,526 | B2 | 3/2016 | Oberg et al. | |
| 9,284,803 | B2 | 3/2016 | Stone et al. | |
| 9,309,733 | B2 | 4/2016 | Xu et al. | |
| 9,316,086 | B2 | 4/2016 | VanLue | |
| 9,359,863 | B2 | 6/2016 | Streich et al. | |
| 9,574,415 | B2 | 2/2017 | Xu et al. | |
| 9,835,003 | B2 | 12/2017 | Harris et al. | |
| 10,000,991 | B2 * | 6/2018 | Harris | E21B 33/1291 |
| 10,107,073 | B2 | 10/2018 | Harris et al. | |
| 10,352,125 | B2 | 7/2019 | Frazier | |
| 11,002,104 | B2 * | 5/2021 | Wolf | E21B 23/01 |
| 11,236,576 | B2 | 2/2022 | Hardesty | |
| 2002/0121379 | A1 | 9/2002 | Doane | |
| 2008/0191420 | A1 | 8/2008 | Imhoff et al. | |
| 2010/0181761 | A1 | 7/2010 | Santi et al. | |
| 2010/0276159 | A1 | 11/2010 | Mailand et al. | |
| 2011/0088891 | A1 * | 4/2011 | Stout | E21B 33/129 166/120 |
| 2011/0259610 | A1 | 10/2011 | Shkurti et al. | |
| 2013/0186649 | A1 | 7/2013 | Xu et al. | |
| 2013/0240201 | A1 | 9/2013 | Frazier | |
| 2014/0209325 | A1 | 7/2014 | Dockweiler et al. | |
| 2014/0227024 | A1 | 8/2014 | Gilling | |
| 2014/0262214 | A1 * | 9/2014 | Mhaskar | E21B 33/1291 166/216 |
| 2015/0068729 | A1 | 3/2015 | Carr et al. | |
| 2015/0129239 | A1 | 5/2015 | Richard | |
| 2015/0300121 | A1 | 10/2015 | Xu | |
| 2016/0145964 | A1 | 5/2016 | Doane et al. | |
| 2016/0186511 | A1 | 6/2016 | Coronado et al. | |
| 2017/0101835 | A1 | 4/2017 | Webster et al. | |
| 2017/0130553 | A1 * | 5/2017 | Harris | E21B 33/1208 |
| 2018/0087347 | A1 | 3/2018 | Rochen et al. | |
| 2020/0056445 | A1 | 2/2020 | Hardesty | |
| 2021/0270099 | A1 * | 9/2021 | Mhaskar | E21B 23/01 |

OTHER PUBLICATIONS

American Completion Tools, *Model Fury 05 Hydraulic Setting Tool Operation Procedure* pp. 50-52 (undated).
Baker Hughes Inc., *Torpedo Composite Frac Plug—Overview* (Copyright 2017).
Baker Hughes, *E-4 Wireline Pressure Setting Assembly and Baker Hughes C Firing Heads* (© 2012-2014).
Baker Hughes, *Model E-4™ Wireline Pressure Setting Assemblies* (© 2014).
Baker Hughes, *SHADOW Series Frac Plug* (© 2014).
Downhole Technology LLC, *Boss Hog Features at a Glance*, www.downholetechnology.com/features-benefits/boss-hog-at-a-glance (Jun. 5, 2017).
Evonik Industries, *CAMPUS® Datasheet—VESTKEEP® L 4000 G-PEEK* (Aug. 25, 2016).
Evonik Industries, *Product Information—VESTAKEEP® L4000G High-Viscosity, Unreinforced Polyether Ether Ketone* (Oct. 2011).
Evonik Industries, *VESTAKEEP® PEEK—Polyether Ether Ketone Compounds* (undated).
Evonik Industries, *VESTAKEEP® PEEK Offers the Strongest Bonding Strength to Withstand Strict Operating Environmental Conditions* (Oct. 27, 2014).
Geodynamics, *FracDock™ Intervention-free Frac Plug System—Frac It and Forget It* (© 2015).
Geodynamics, *SmartStart PLUS™*(undated).
Halliburton, *Fas Drill® Bridge Plug* (© 2014).
Halliburton, *Halliburton 250-Series Frac Plugs* (© 2012).
Halliburton, *Obsidian® Frac Plug* (Copyright 2015).
Halliburton, *Wireline Setting Tools* (© 2015).
High Pressure Integrity, Inc., *Direct Pump Setting Tool DPST—Chapter 6* (© 2008 Weatherford).
Magnum Oil Tools Int'l, *Composite Frac Plugs—Magnum Series* (May 16, 2017).
Nine Energy Service, *Scorpion High-Quality, Fully Composite Plugs* (undated).
Owen Oil Tool, *Big Bore Frac Plug* (© 2002).
Peak Completions, *Set-a-Seat™ Pump-Down Casing Baffle* (© 2014-15).
Schlumberger, *Copperhead Big Bore Flow-Through Frac Plug* (© 2014).
Schlumberger, *Diamondback Composite Drillable Frac Plug* (© 2016).
Schlumberger, *Model E Hydraulic Setting Tool* (© 2014).
Superior Energy Services, *OmniFrac™ Systems* (undated).
Tam International, *PosiFrac HALO™—Large Bore Fracture Seat* (2016).
Unknown, *Baker Style #20 Setting Tool* (undated).
Weatherford, *TruFrac® Composite Frac Plug—Optimizing Costs in Plug-and-Perf Operations* (undated).
Weatherford, *TruFrac® Composite Frac Plug* (© 2015).
Weatherford, *TruFrac® Composite Frac Plug* (undated).
PCT International Search Report in PCT/US2021/044020 (dated Nov. 8, 2021).
PCT Written Opinion of the Int'l Searching Authority in PCT/US2021/044020 (dated Nov. 8, 2021).

* cited by examiner

FRAC PLUG WITH COLLAPSIBLE PLUG BODY HAVING INTEGRAL WEDGE AND SLIP ELEMENTS

FIELD OF THE INVENTION

The present invention relates generally to plugs that may be used to isolate a portion of a well, and more particularly, to plugs that may be used in fracturing and other processes for stimulating oil and gas wells.

BACKGROUND OF THE INVENTION

Hydrocarbons, such as oil and gas, may be recovered from various types of subsurface geological formations. The formations typically consist of a porous layer, such as limestone and sands, overlaid by a nonporous layer. Hydrocarbons cannot rise through the nonporous layer. Thus, the porous layer forms a reservoir, that is, a volume in which hydrocarbons accumulate. A well is drilled through the earth until the hydrocarbon bearing formation is reached. Hydrocarbons then can flow from the porous formation into the well.

In what is perhaps the most basic form of rotary drilling methods, a drill bit is attached to a series of pipe sections or "joints" referred to as a drill string. The drill string is suspended from a derrick and rotated by a motor in the derrick. A drilling fluid or "mud" is pumped down the drill string, through the bit, and into the bore of the well. This fluid serves to lubricate the bit. The drilling mud also carries cuttings from the drilling process back to the surface as it travels up the wellbore. As the drilling progresses downward, the drill string is extended by adding more joints of pipe.

When the drill bit has reached the desired depth, larger diameter pipes, or casing, are placed in the well and cemented in place to prevent the sides of the borehole from caving in. The well may be extended by drilling additional sections and installing large, but somewhat smaller pipes, or liners. The liners also are typically cemented in the bore. The liner may include valves, or it may then be perforated. In either event, openings in the liner are created through which oil can enter the cased well. Production tubing, valves, and other equipment are installed in the well so that the hydrocarbons may flow in a controlled manner from the formation, into the lined well bore, and through the production tubing up to the surface for storage or transport.

Hydrocarbons, however, are not always able to flow easily from a formation to a well. Some subsurface formations, such as sandstone, are very porous. Hydrocarbons can flow easily from the formation into a well. Other formations, however, such as shale rock, limestone, and coal beds, are only minimally porous. The formation may contain large quantities of hydrocarbons, but production through a conventional well may not be commercially practical because hydrocarbons flow though the formation and collect in the well at very low rates. The industry, therefore, relies on various techniques for improving the well and stimulating production from formations that are relatively nonporous.

Perhaps the most important stimulation technique is the combination of horizontal wellbores and hydraulic fracturing. A well will be drilled vertically until it approaches a formation. It then will be diverted, and drilled in a more or less horizontal direction, so that the borehole extends along the formation instead of passing through it. More of the formation is exposed to the borehole, and the average distance hydrocarbons must flow to reach the well is decreased. Fractures then are created in the formation that will allow hydrocarbons to flow more easily from the formation.

Fracturing a formation is accomplished by pumping fluid, most commonly water, into the well at high pressure and flow rates. Proppants, such as grains of sand, ceramic or other particulates, usually are added to the fluid along with gelling agents to create a slurry. The slurry is forced into the formation at rates faster than can be accepted by the existing pores, fractures, faults, vugs, caverns, or other spaces within the formation. Pressure builds rapidly to the point where the formation fails and begins to fracture. Continued pumping of fluid into the formation will tend to cause the initial fractures to widen and extend further away from the wellbore, creating flow paths to the well. The proppant serves to prevent fractures from closing when pumping is stopped.

Fracturing typically involves installing a production liner in the portion of the wellbore passing through the hydrocarbon bearing formation. The production liner may incorporate valves, typically sliding sleeve "ball-drop" valves, to divert fluid into the formation. More commonly, however, the production liner does not incorporate valves. Instead, fracturing will be accomplished by "plugging and perfing" the liner.

In a "plug and perf" job, the production liner is made up from standard joints of liner. The liner does not have any openings through its sidewalls, nor does it incorporate frac valves. It is installed in the wellbore, and holes then are punched in the liner walls. The perforations typically are created by so-called "perf" guns that discharge shaped charges through the liner and, if present, adjacent cement. Fluids can be flowed through the perforations into the formation.

A well rarely, if ever, is fractured all at once. It typically will be fractured in many different locations or "zones" and in many different stages. Typically, the first zone will be at the bottom or "toe" of the well, and fluid will be injected through a toe valve. The toe valve is opened to initiate fracturing. Fluids then are pumped into the well to fracture the formation in the vicinity of the toe valve.

After the initial zone is fractured, pumping is stopped. A plug is installed in the liner at a point above the fractured zone. The liner is perforated in a second zone located above the plug. A ball then is deployed onto the plug. The ball will restrict fluids from flowing through and past the plug. When fluids are injected into the liner, therefore, they will be forced to flow out the perforations and into the second zone. After the second zone is fractured, the process of plugging, perforating, and injecting is repeated until all zones in the well are fractured.

After the well has been fractured, however, plugs may interfere with installation of production equipment in the liner. They also may restrict the flow of production fluids upward through the liner. Thus, the plugs typically are removed from the liner after the well has been fractured. Retrievable plugs are designed to be set and then unset. Once unset, they may be removed from the well. Non-retrievable plugs cannot be "unset," and must be removed to open up the liner. Most commonly, the plugs will be drilled out. Increasingly, however, plugs are being fabricated from dissolvable materials that allow the plug to disintegrated over time upon exposure to well fluids.

Frac plugs must resist very high hydraulic pressure—often as high as 15,000 psi or more. They also may be exposed to elevated temperatures and corrosive liquids. Thus, frac plugs traditionally have been fabricated from relatively durable materials such as steel. Frac plugs with metal components have greater structural strength, and that strength may make it easier to install the plug. Metal components also may be less likely to loosen up and become unset, and they are more resistant to corrosion. On the other hand, the required service life of frac plugs may be relatively short, and metallic plugs are difficult to drill out.

Thus, some or all of the components of many conventional non-retrievable frac plugs now are fabricated from more easily drillable materials. Such materials include cast iron, aluminum, and other more brittle or softer metals. Other, more easily drillable materials include fiberglass, carbon fiber materials, and other composite materials. Composite materials are more easily drilled and, therefore, can make it easier to drill out a plug. They also can allow for less aggressive drilling and reduce the likelihood and extent of damage to the liner during drilling.

Many conventional composite plugs have a common basic design built around a central support mandrel. The support mandrel is generally cylindrical and somewhat elongated. It has a central conduit extending axially through it. The support mandrel serves as a core for the plug and provides support for the other plug components. The other plug components—slips, wedges, and sealing elements—are all generally annular and are carried on and around the support mandrel in an array extending along the length of the mandrel.

More particularly, an upper set of slips is carried on the support mandrel adjacent to an upper wedge (also referred to as a "cone"). A lower set of slips is disposed adjacent to a lower wedge. The slips and wedges have mating, ramped surfaces. An annular sealing element, usually an elastomeric sealing element, is carried on the support mandrel between the upper and lower wedges. The sealing element often is provided with backup rings to minimize extrusion of the seal. The various components are carried on the support mandrel such that they may slide along the mandrel.

Such conventional frac plugs have nominal outer diameters in their "unset" position that allow them to be deployed into a liner. Once deployed, they will be set by radially expanding the slips and sealing element into contact with the liner walls. More specifically, the plugs are installed with a setting tool that may be actuated to apply opposing axial forces to the components carried around the support mandrel. The compressive forces cause the components to slide axially along the support mandrel and squeeze together. As they are squeezed together, the ramped surfaces on the inside of the slips will cause the slips to ride up the ramped outer surface of the wedges. As they ride up the outer surface of the wedges, the slips expand radially until they contact the inner wall of the liner. The outer surfaces of the slips have teeth, serrations, and the like that enable the slips to jam and bite into the liner wall. The slips, therefore, provide the primary anchor that secures the plug in the liner.

Squeezing the components also will cause the elastomeric sealing element to expand radially until it seals against the liner wall. Backup rings, if present, serve to minimize axial extrusion of the elastomeric material as it is squeezed between the upper and lower wedges and while the plug is under pressure. The elastomeric sealing element thus can minimize or eliminate flow around the plug, i.e., between the plug and the liner wall.

The support mandrel has a ball seat at or very near the upper end of the mandrel central conduit. Once the plug is installed, and the setting tool withdrawn, fluids can flow in both directions through the central conduit. A ball may be deployed or "dropped" onto the ball seat, however, to substantially isolate the portions of the liner below the plug. The ball will restrict fluid from flowing downward through the plug.

Such designs are well known in the art. Variations thereof are disclosed, for example, in U.S. Pat. No. 7,475,736 to D. Lehr et al., U.S. Pat. No. 7,789,137 to R. Turley et al., U.S. Pat. No. 8,047,280 to L. Tran et al., and U.S. Pat. No. 9,316,086 to D. VanLue. Plugs of that general design also are commercially available, such as Schlumberger's Diamondback composite drillable frac plug and Weatherford's TruFrac composite frac plug.

While they allow the plug to be drilled more easily and quickly, composite materials lack the durability and strength of metals such as steel, cast iron, and aluminum. Plugs fabricated from composite materials may not hold their set or seal. They may be dislodged, damaged, or leak during the fracturing process as composite materials generally lack the hardness and yield strength of metals. Composites also have much lower lateral shear strengths. Thus, composite plugs are more susceptible to being "blown out" if a ball deployed too rapidly into the plug or when hydraulic pressure above the ball is increased.

Such deficiencies often are minimized by increasing the length and thickness of the plug components. For example, making a support mandrel thicker will increase its radial yield strength and will help maintain the engagement of the slips with a liner wall. A longer support mandrel also will have a proportionately higher lateral shear strength and, therefore, is better able to resist the force of a ball seated in the mandrel passageway. Increasing the size of the components, however, necessarily increases the time required to drill the plug. Larger components also increase the amount of debris that must be circulated out of the well, debris that otherwise may interfere with production equipment that will be installed in the liner.

Additionally, while many of their components are fabricated from composites, many so-called composite plugs still may incorporate metal components that can slow down or complicate drilling out the plug. For example, many predominantly composite plugs incorporate metallic slips that increase the time required to drill out the plug. Metal slips also can break up into relatively large pieces that may be more difficult to circulate out of a well. Other "composite" plugs incorporate metal backup rings to minimize extrusion of elastomeric seals. Metal rings can become entangled around the bit used to drill the plug.

Even with composite plugs, drill out operations can be costly and time consuming. Coil tubing drill outs typically cost $100,000.00 per day, and the process may take two to three days. A plug and perf frac job may require the installation of dozens of plugs. Thus, even a small increase in the time required to drill an individual plug may considerably lengthen the overall cost and time required for the operation.

U.S. Pat. No. 9,835,003 to M. Harris et al. discloses a plug that addresses many issues attendant other composite plugs. It lacks a central mandrel. Instead, it comprises slips and a sealing ring that are carried around a wedge. The plug is installed by compressing the wedge into the slips and sealing ring. The wedge and slips are fabricated from composite materials, while the sealing ring preferably is fabricated from plastic that deforms plastically. The plug typically lacks any metallic parts. The ball seat also is situated so that when the plug is set, it is well below the midpoint of the slips. Hydraulic pressure applied above the plug, therefore, will generate radial pressure that reinforces the anchoring engagement of the slips against the liner and the seal provided by the sealing ring. The Harris '003 plugs not only can provide reliable isolation, but can be provided with a larger central bore, can be fabricated from less material, and allow quicker, easier drilling than many conventional composite plugs.

Despite such improvements, however, many plugs of all designs and materials fail to perform as intended in the field because of poor quality control in the manufacturing process. Frac plugs are assembled from a number of parts. The fabrication of all those parts, and the assembly of those parts into a finished plug must be controlled carefully to ensure that once assembled the plug will operate as designed. For example, proper installation of a plug depends on the sequence and timing of the radial expansion of the slips and seals. That sequence and timing is determined by the force and stroke of the setting tool and by the design of the plug components. If the components do not meet design specifications, the slips and seals may not engage the liner in the proper sequence or at the right time. The slips may engage the liner prematurely, for example, anchoring the plug, but the seals may not be expanded enough to provide an effective seal.

Some variation among the parts, and among the resulting optimal setting force and stroke for the finished plugs may be tolerated of course. They are much tighter, however, in composite plugs. Because they are made of softer materials, the force and stroke of the setting tool used to set composite plugs is generally lower and must be more carefully matched to the design of the plug to ensure that the plug is both anchored and sealed within the liner. Manufacturing tolerances for the component parts must be controlled more carefully. Material properties also may change from part to part. Wound fiber resin blanks, for example, may have significantly different shear and other mechanical properties from blank to blank. That makes it more difficult to optimize and control setting forces and strokes and, therefore, to ensure consistent and effective installation of plugs.

In the Harris '003 plug, for example, the seal ring and slips must contact the liner very nearly at the same time. Otherwise, the plug may seal, but may not be anchored sufficiently, or vice versa. The plug, however, has multiple slip segments each having multiple hardened buttons that project from the slips and bite into liner walls. Variations in the dimensions of the slips, and lack of precision in mounting the buttons, for example, can cause the slips to contact the liner at significantly different times in different plugs. Thus, the slips may engage prematurely, potentially resulting in an ineffective seal. Alternately, they may engage late, potentially diminishing the strength of the engagement between the slips and the liner. Eliminating such issues from the manufacturing process may be difficult and costly.

In summary, frac plugs must be capable of being run into and installed in the liner in a reliable and predictable manner. When installed, they must be anchored securely and provide an effective and robust seal so that the plug is capable of diverting frac fluids pumped into the liner at high-pressures and flow rates. They also must be removed quickly, cheaply, and effectively once well operations are completed and they are no longer needed. At the same time, because a well may be fractured in many different zones and require many plugs, it is important that the plugs can be fabricated economically and with precision.

The statements in this section are intended to provide background information related to the invention disclosed herein. Such information may or may not constitute prior art. It will be appreciated from the foregoing, however, that there remains a need for new and improved frac plugs and isolation plugs that can be used in other well stimulation processes. Such disadvantages and others inherent in the prior art are addressed by various aspects and embodiments of the subject invention.

SUMMARY OF THE INVENTION

The subject invention, in its various aspects and embodiments, relates generally to plugs that may be used to isolate a portion of a well and encompasses various embodiments and aspects, some of which are specifically described and illustrated herein. Embodiments of One broad embodiment provides for a frac plug apparatus having a plug body. The plug body comprises a central bore and separable elements. The central bore extends axially through the plug body. The separable elements are joined by relatively weak bridging portions that are adapted to break in a controlled manner. The separable elements thereby form an integral component comprised of the separable elements. The separable elements comprise a wedge element and an array of slip elements joined to the wedge element by first bridging portions. The separable elements allow the novel plug to self-assemble in a controlled sequence as compressive forces collapse the plug during installation Other embodiments provide such frac plug apparatus where the plug may be set by applying along the primary axis of the plug body a first compressive force across the first bridging portions. The first compressive force is effective to break the first bridging portions and shift the slip elements and the wedge into overlapping engagement. The slip elements are displaced radially.

Yet other embodiments provide such frac plug apparatus where the wedge element has a tapered outer surface and the slip elements have a complimentarily tapered inner surface. The first bridging portions joining the wedge element and the slip elements are situated at the lower end of the wedge element and the upper end of the slip elements.

Still other embodiments provide such frac plug apparatus where the slip elements are configured generally as lateral segments of an open cylinder. The slip elements are separated by longitudinal slits extending through the plug body.

Further embodiments provide such frac plug apparatus where the slits comprise a first and second sets of slits. The first set of slits originates at the upper end of the slip elements and terminates proximate the lower end of the slip elements. The second set of slits originates at the lower end of the slip elements and terminates proximate the upper end of the slip elements.

Other embodiments provide such frac plug apparatus where the first bridging portions shear generally along an annular plane aligned with the tapered surfaces of the wedge element and the slip elements.

Yet other embodiments provide such frac plug apparatus where the wedge element comprises first and second ramping surfaces.

Still other embodiments provide such frac plug apparatus where the separable elements comprise a setting ring element joined to the slip elements by second bridging portions. The plug may be set by applying along the primary axis of the plug body a second compressive force across the second bridging portions. The second compressive force is effective to break the second bridging portions and shift the slip elements and the setting ring element into abutment.

Further embodiments provide such frac plug apparatus where the first compressive force is greater than the second compressive force whereby the second bridging portions break before the first bridging portions break.

Other embodiments provide such frac plug apparatus where the slip elements have a cylindrical inner surface and the setting ring element has a complimentary cylindrical outer surface. The second bridging portions joining the slip elements and the setting ring element are situated at the lower end of the slip elements and the upper end of the setting ring element.

Yet other embodiments provide such frac plug apparatus where the second bridging portions break generally along a plane coextensive with the cylindrical surfaces of the slip elements and the setting ring element.

Still other embodiments provide such frac plug apparatus where the outer surface of the slip elements is provided with means for enhancing engagement and gripping of a tubular wall and where the gripping means are ceramic, heat-treated steel, sintered powder metal, or carbide buttons.

Further embodiments provide such frac plug apparatus where the plug body is fabricated from a wound-fiber resin blank and where the plug body is fabricated from a dissolvable metal.

Other embodiments provide such frac plug apparatus where the tapered outer surface of the wedge and the tapered inner surface of the slip are provided with a taper from about 1° to about 10° off center and where the tapered outer surface of the wedge and the tapered inner surface of the slip provide a self-locking taper fit between the wedge element and the slip element.

Yet other embodiments provide such frac plug apparatus where the plug comprises a cup seal coupled to the plug body above the wedge element.

Still other embodiments provide such frac plug apparatus where the separable elements comprise an array of seal backup elements. The backup elements overlay a lower portion of the cup seal and are joined to the wedge element by third bridging portions. The seal backup elements may be set by applying hydraulic pressure to the cup seat The hydraulic pressure is effective to expand the cup seal radially and break the third bridging portions to allow the seal backup elements to separate and shift radially outward.

Further embodiments provide such frac plug apparatus where the backup elements are configured generally as lateral segments of an open cylinder. The backup elements are separated by longitudinal slits extending through the plug body. The slits originate at the upper end of the plug body and terminate proximate to the wedge element.

Other embodiments provide such frac plug apparatus where the plug body defines an internal, annular grove proximate to the upper end of the wedge element. The cup seal has an annular rim projecting radially outward proximate the lower end of the cup seal and into the plug body annular groove.

Yet other embodiments provide such frac plug apparatus where the cup seal is fabricated from a dissolvable elastomer.

Still other embodiments provide such frac plug apparatus where the wedge element has an outer surface that tapers radially inward in a downhole direction to provide an inverted truncated conical lower ramping surface and an outer surface that tapers radially inward in an uphole direction to provide a truncated conical upper ramping surface. The slip elements have a tapered inner surface complimentary to the wedge lower ramping surface. The first bridging portions joining the wedge element and the slip elements are situated at the lower end of the wedge element and the upper end of the slip elements. The plug comprises a cup seal carried on the upper ramping surface. The cup seal has a tapered inner surface complimentary to the upper ramping surface.

Further embodiments provide such frac plug apparatus where the plug comprises a thrust ring abutting the upper end of the plug body and the upper face of the cup seal. The cup seal may be set by applying along the primary axis of the plug a third compressive force between the wedge element and the thrust ring. The third compressive force is effective to shear the thrust ring and shift the cup seal up the upper ramping surface and radially outward.

Other embodiments provide such frac plug apparatus where the plug comprises a seal backup ring carried on the upper ramping surface below the cup seal. The seal backup ring has a tapered inner surface complimentary to the upper ramping surface.

Yet other embodiments provide such frac plug apparatus where the seal backup ring comprises an array of seal backup elements joined to each other by ring bridging portions. The seal backup elements may be set by applying the third compressive force to break the ring bridging portions and allow the seal backup elements to separate and to shift the seal backup elements up the upper ramping surface and radially outward.

Still other embodiments provide such frac plug apparatus where the backup elements of the seal backup ring are configured generally as lateral segments of an open cylinder. The backup elements are separated by longitudinal slits extending through the seal backup ring. The slits originate at the upper end of the seal backup ring and terminate proximate to the lower end of the seal backup ring.

Further embodiments provide such frac plug apparatus where the wedge element has an outer surface that tapers radially inward in a downhole direction to provide an inverted truncated conical lower ramping surface and an outer surface that tapers radially inward in an uphole direction to provide a truncated conical upper ramping surface. The slip elements have a tapered inner surface complimentary to the wedge lower ramping surface. The first bridging portions joining the wedge element and the slip elements are situated at the lower end of the wedge element and the upper end of the slip elements. The plug comprises a radially expandable seal ring carried on the upper ramping surface. The seal ring comprises an annular ring body having a tapered inner surface complimentary to the wedge upper ramping surface.

Other embodiments provide such frac plug apparatus where the ring body of the seal ring is fabricated from a sufficiently ductile material such that the ring body can expand radially without breaking from an unset condition to a set condition. In the unset condition the seal ring has a nominal outer diameter. In the set condition it has an enlarged outer diameter. The plug may be set by applying along the primary axis of the plug a third compressive force between the wedge element and the seal ring. The third compressive force is effective to shift the seal ring up the upper ramping surface from an unset position to a set position and to expand the seal ring radially outward from the unset condition to the set condition.

Yet other embodiments provide such frac plug apparatus where the seal ring is fabricated from a plastically deformable plastic, where the seal ring is fabricated from plastically deformable plastics selected from the group consisting of polycarbonates, polyamides, polyether ether ketones, and polyetherimides and copolymers and mixtures thereof, and where the annular ring body is fabricated from a plastically deformable plastic and has an elongation factor of at least about 10%.

Further embodiments provide such frac plug apparatus where the seal ring comprises an outer elastomeric seal received in a groove provided in the outer surface of the ring body.

Other embodiments provide such frac plug apparatus where the plug comprises a seal backup ring carried on the upper ramping surface of the wedge element below the seal ring and adapted to burst when the third compressive force is applied.

Yet other embodiments provide such frac plug apparatus where the seal backup ring is fabricated from plastic.

Still other embodiments provide an oil and gas well comprising a liner, wherein the novel frac plug apparatus has been installed by driving the wedge element into the slip elements.

In other aspects and embodiments, the subject invention provides for methods of setting a plug in a liner. One broad embodiment provides such methods where the plug is run into the liner to a location to be plugged. The plug comprises a plug body and is in an unset state. A first compressive force is applied along the primary axis of the plug body and across a wedge element of the plug body and an array of slip elements of the plug body. The first compressive force breaks first bridging portions of the plug body joining the wedge element and the slip elements. The wedge element is driven into the slip elements to radially expand the slip elements into engagement with the liner and anchor the plug in the liner.

Other embodiments provide such methods where a second compressive force is applied along the primary axis of the plug body and across the slip elements and a setting ring element of the plug body. The second compressive force breaks second bridging portions of the plug body joining the slip elements and the setting ring element. The setting ring is driven into abutment with the slip elements. The first compressive then is applied to break the first bridging portions and drive the wedge element into the slip elements.

Yet other embodiments provide such methods where hydraulic pressure is applied to a cup seal coupled to the plug body to generate radial load on the cup seal and press the cup seal into sealing engagement with the liner. The hydraulic force is applied after the wedge element is driven into the slip elements.

Still other embodiments provide such methods where the application of the hydraulic force breaks third bridging portions of the plug body joining an array of seal backup elements of the plug body to the wedge element and radially expands a portion of the cup seal to shift the backup elements radially outward into engagement with the liner.

Further embodiments provide such methods where a ball is deployed onto a ball seat in the wedge element. The hydraulic force is generated by pumping liquid into the liner.

Other embodiments provide such methods where the first compressive force is applied to drive a first ramping surface of the wedge element into the slip elements. A third compressive force is applied along the primary axis of the plug and across a thrust ring and the wedge element. The thrust ring abuts the upper end of the wedge element and abuts a cup seal carried on a second ramping surface of the wedge element. The third compressive force shears the thrust ring. A sheared portion of the thrust ring is driven across a portion of the wedge element. The sheared portion of the thrust ring bears on the cup seal and drives the cup seal up the second ramping surface to radially expand the cup seal into engagement with the liner.

Yet other embodiments provide such methods where the first compressive force is applied to drive a first ramping surface of the wedge element into the slip elements. A third compressive force is applied along the primary axis of the plug and across a seal ring and the wedge element. The seal ring is carried on a second ramping surface of the wedge element and is driven up the second ramping surface to radially expand the seal ring into engagement with the liner.

Still other embodiments provide such methods where the third compressive force is applied to break a backup ring carried on the second ramping surface downhole of the seal ring and then to drive the seal ring and the backup ring up the second ramping surface.

In other aspects and embodiments, the subject invention provides for tools setting a plug having an annular seal in a liner. A broad embodiment of the novel tools comprises an outer push member adapted for releasable connection to the plug, an inner pull member adapted for releasable connection to the plug, and a seal sheath. The seal sheath is coupled to the inner pull member by a connector extending through the outer push member. When the tool is connected to the plug in an unset position, the seal sheath is in a first position extending annularly around and substantially covering the outer surface of the plug annular seal. The outer push member and the inner pull member are adapted for linear movement relative to each other. When the outer push member and the inner pull member move linearly relative to each other, the inner pull member moves the seal sheath from the first position covering the plug annular seal to a second position uncovering the plug annular seal.

Other embodiments provide such tools where the tool is an adaptor for a force-generating setting apparatus. The tool outer push member is adapted for coupling to an outer push drive of the setting apparatus. The setting apparatus is adapted to generate force on the apparatus push drive to induce linear movement of the tool outer push member in a downhole direction. The tool inner pull member is adapted for coupling to an inner pull drive of the setting apparatus. The setting apparatus is adapted to generate force on the apparatus pull drive to induce linear movement of the tool inner pull member in an uphole direction. When the setting apparatus is coupled to the tool and is activated, the apparatus outer push drive induces downhole linear movement of the tool outer push member, and the apparatus inner pull drive induces uphole linear movement of the tool inner pull member. The sheath is moved from the first position covering the plug annular seal to the second position uncovering the plug annular seal.

Yet other embodiments provide such tools where the outer push member comprises an outer connector and an outer push sleeve. The outer connector is adapted for coupling at a first end to the setting apparatus outer push drive. The outer push sleeve has a first end connected to the outer connector at a second end thereof and a second end adapted for releasable connection to the plug. The inner pull member comprises an inner connector and an inner pull mandrel. The inner connector is adapted for coupling at a first end to the setting apparatus inner pull drive. The inner pull mandrel has a first end connected to the inner connector at a second end thereof and a second end adapted for releasable connection to the plug.

Still other embodiments provide such tools where the outer push member has a slot extending longitudinally through the outer push member. The sheath connector extends from the seal sheath through the slot to the inner pull member.

Further embodiments provide such tools where the outer push member has a pair of the slots disposed radially at an angle of 180°. The inner pull member has a passage extending transversely through the inner pull member. The connector extends across opposing inner surfaces of the seal sheath and through the slots in the outer push member and the passage in the inner pull member.

Other embodiments provide such tools where the inner pull member has a hole extending radially into the inner pull member. The connector extends radially inward from the seal sheath and through the slot and into the inner pull member hole.

Yet other embodiments provide such tools where the connector is a roll pin.

Still other embodiments provide such tools where the tool comprises a coupling ring. The coupling ring is carried on the inner pull member and has a hole extending radially into the coupling ring. The connector extends radially inward from the seal sheath and through the slot and into the coupling ring hole.

Finally, still other aspects and embodiments of the invention provide apparatus and methods having various combinations of such features as will be apparent to workers in the art.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention, They are included to provide a better understanding of the invention and the manner in which it may be practiced. The subject invention encompasses other embodiments consistent with the disclosure provided herein.

Figure 1:
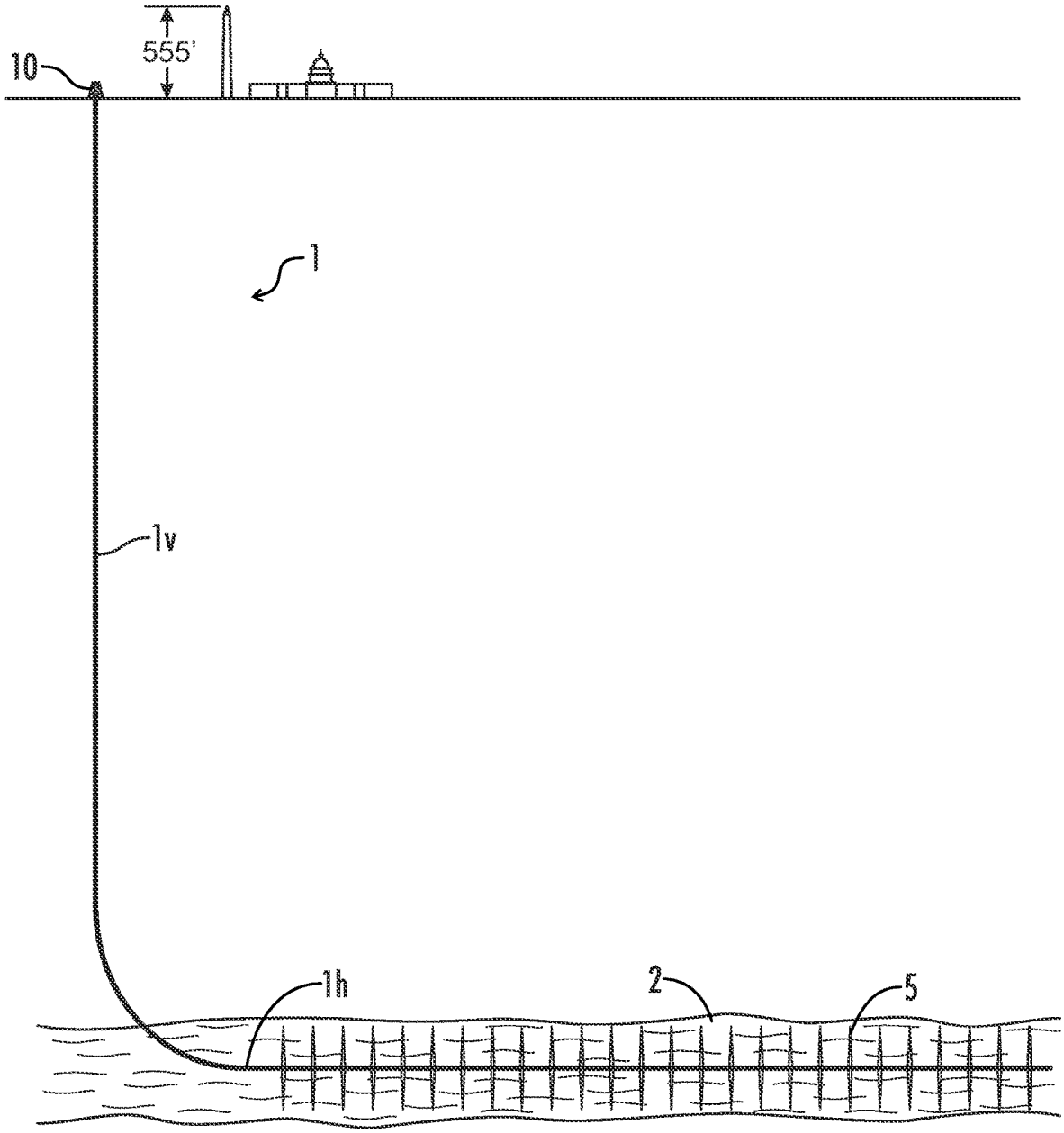
FIG. 1 (prior art) is a schematic depiction in approximate scale of an oil and gas well 1 having a vertical extension 1*v* and a horizontal extension 1*h*.

In the drawings and description that follows, like parts are identified by the same reference numerals. The drawing figures also are not necessarily to scale. Certain features of the embodiments may be shown exaggerated in scale or in somewhat schematic form and some details of conventional design and construction may not be shown in the interest of clarity and conciseness. For example, certain features and components of the embodiments shown in the figures have been omitted to better illustrate the remaining components.

DESCRIPTION OF ILLUSTRATIVE EMBODIMENTS

The invention, in various aspects and embodiments, is directed generally to plugs that may be used to isolate a portion of a well, and more particularly, to plugs that may be used in fracturing or other processes for stimulating oil and gas wells. In general, the novel plugs have plug bodies with separable elements and other features that allow the plug to self-assemble in a controlled sequence as compressive forces collapse the plug during installation.

Various specific embodiments will be described below. For the sake of conciseness, however, all features of an actual implementation may not be described or illustrated. In developing any actual implementation, as in any engineering or design project, numerous implementation-specific decisions must be made to achieve a developer's specific goals. Decisions usually will be made consistent within system-related and business-related constraints. Specific goals may vary from one implementation to another. Development efforts might be complex and time consuming and may involve many aspects of design, fabrication, and manufacture. Nevertheless, it should be appreciated that such development projects would be routine effort for those of ordinary skill having the benefit of this disclosure.

Overview of Fracturing Operations

The complexity and challenges of completing and producing a well perhaps may be appreciated by reference to FIG. 1. FIG. 1 shows a well 1 approximately to scale. Well 1 includes a vertical portion 1*v* and a horizontal portion 1*h*. Schematic representations of the Washington Monument, which is 555 feet tall, and the Capital Building are shown next to a derrick 10 to provide perspective. Well 1 has a vertical depth of approximately 6,000 feet and a horizontal reach of approximately 6,000 feet. Such wells are typical of wells in the Permian Basin, an oil-rich basin located mostly in Texas. Deeper and longer wells, however, are constructed both in the Permian and elsewhere. While neither the vertical portion 1*v* or the horizontal portion 1*h* of well 1 necessarily run true to vertical or horizontal, FIG. 1 provides a general sense of what is involved in oil and gas production. Well 1 is targeting a relatively narrow hydrocarbon-bearing formation 2, and all downhole equipment must be installed and operated far away from the surface.

Figure 2A:
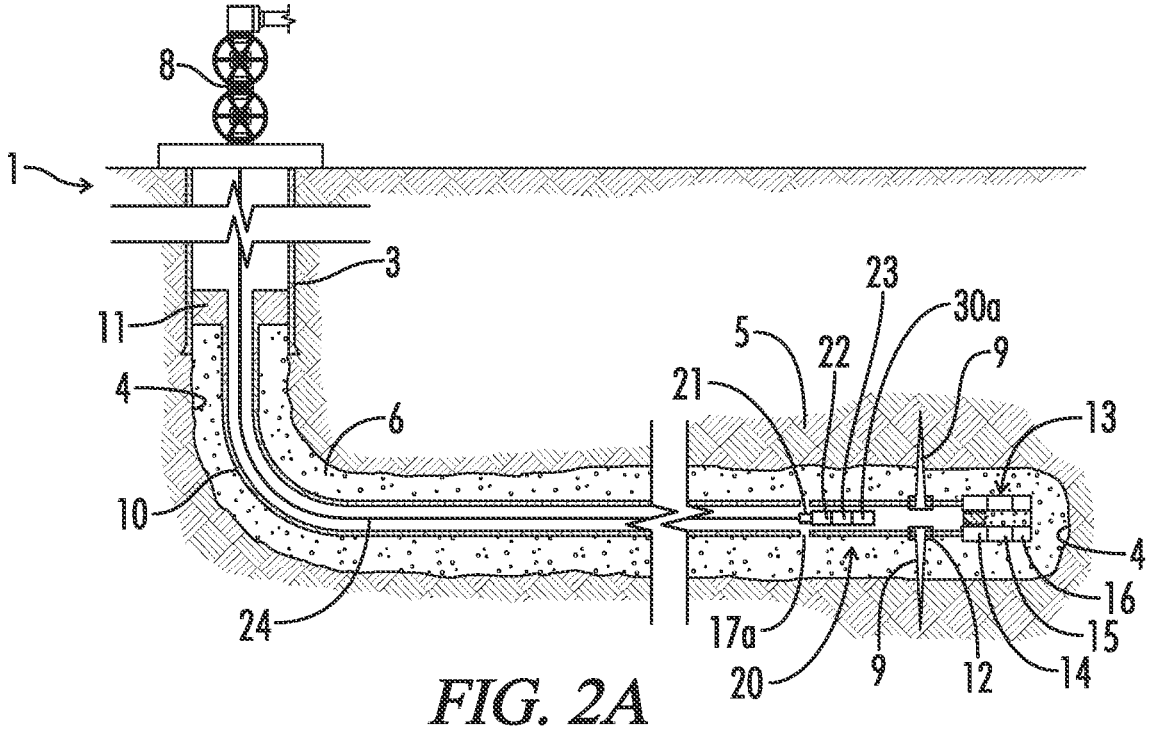
FIG. 2A is a schematic illustration of an early stage of a plug and perf fracturing operation which shows a wireline tool string 20 deployed through a wellhead assembly 8 into a liner assembly 10, where tool string 20 includes a perf gun 21, a setting tool 22, an adaptor 23, and a frac plug 30*a*.
Figure 2B:
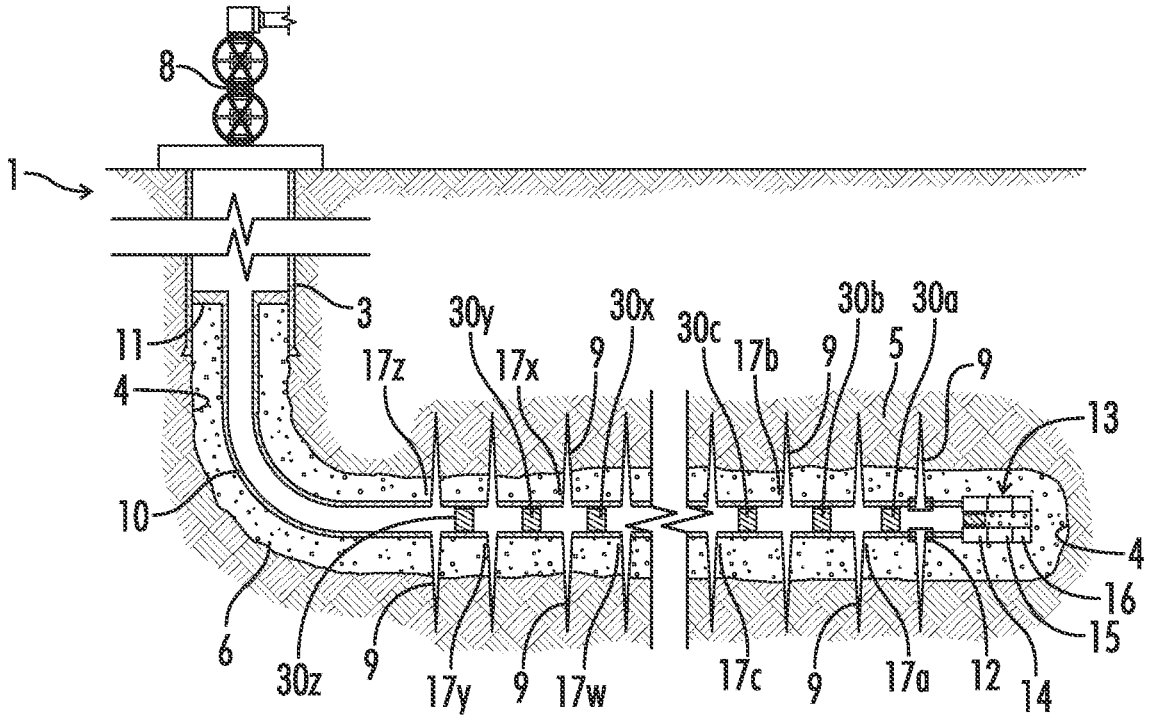
FIG. 2B is a schematic illustration of liner assembly 10 after completion of the plug and perf fracturing operation, but before removal of plugs 30 from liner 10.
Figure 3:
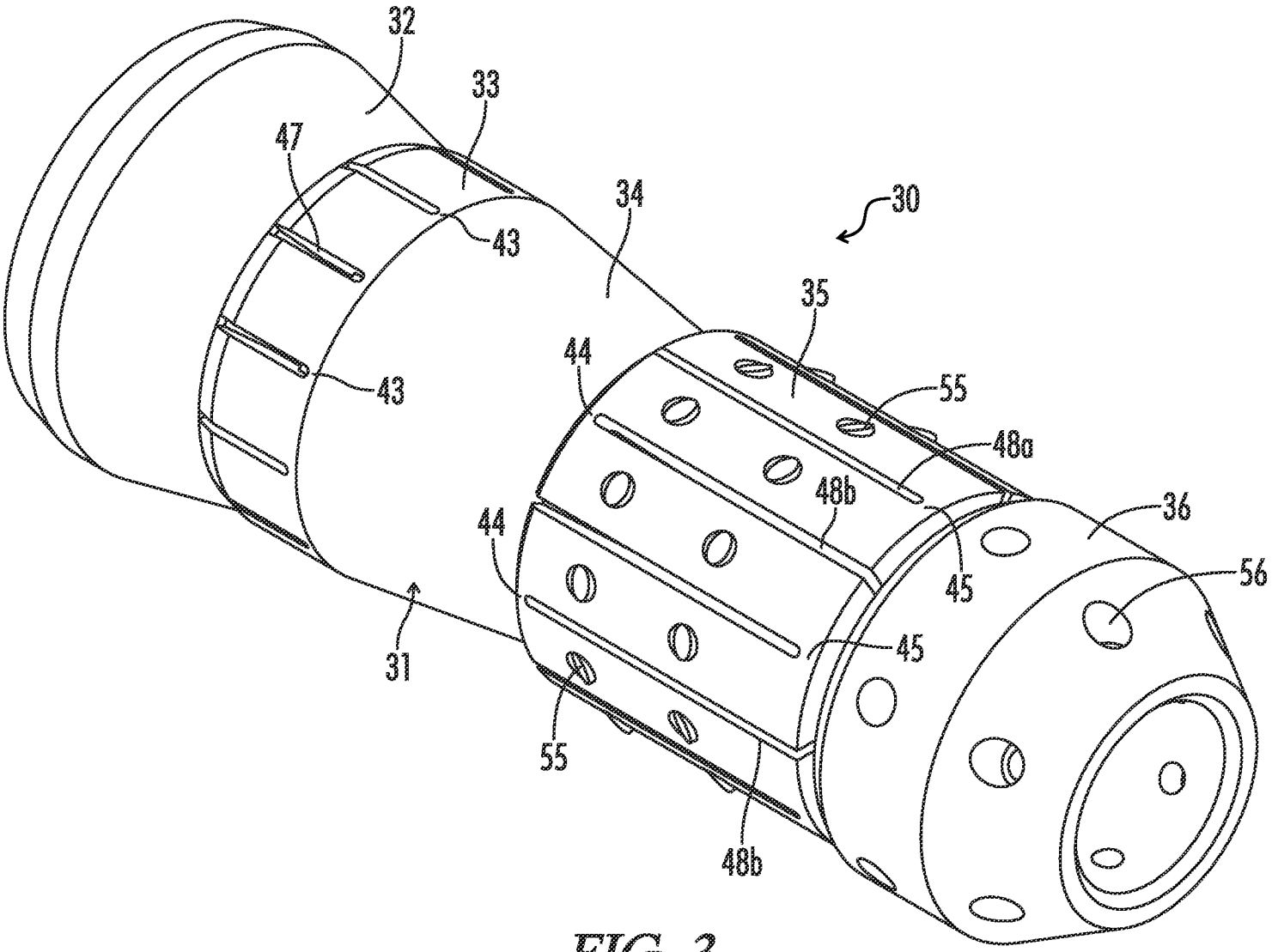
FIG. 3 is an isometric view, taken from above, from the lower end, and to the side of a first preferred embodiment 30 of the novel frac plugs of the subject invention.
Figure 4:
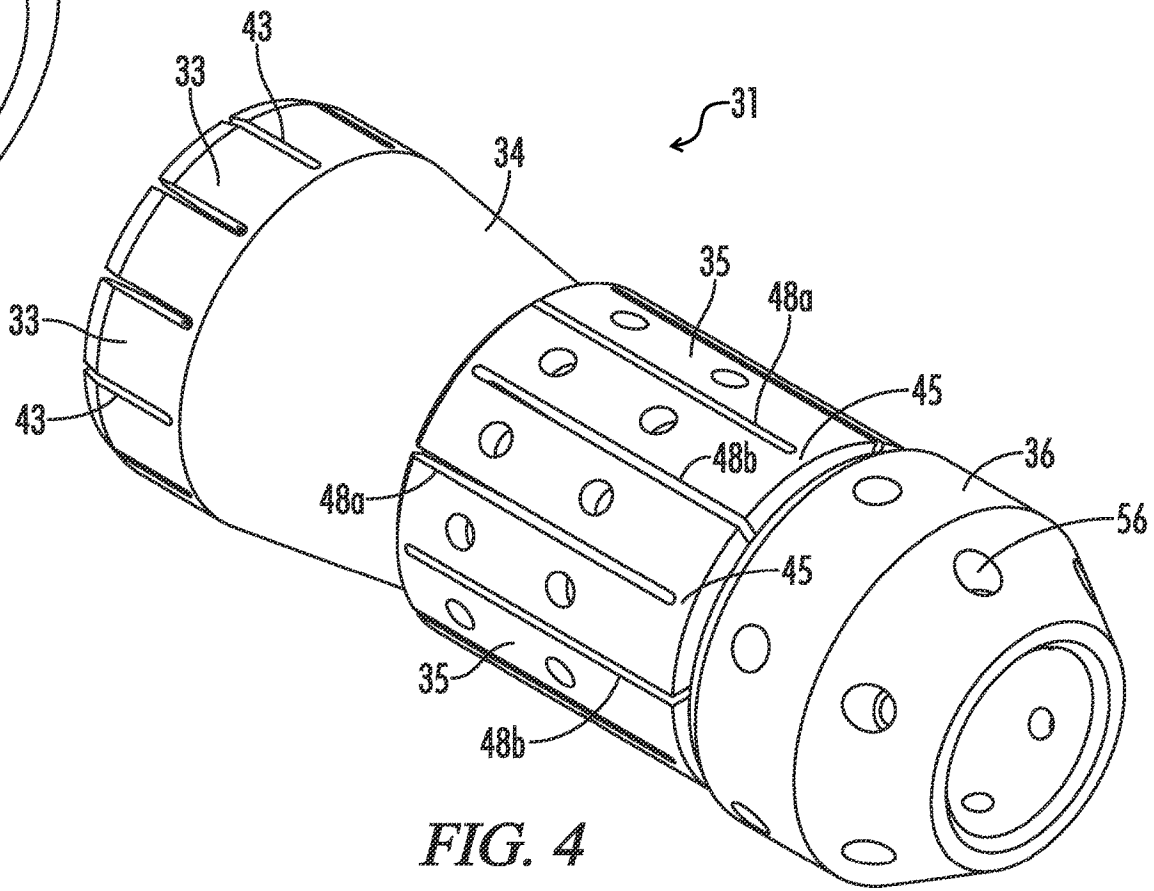
FIG. 4 is an isometric view, similar to the view of FIG. 3, of a plug body 31 of frac plug 30.
Figure 5:
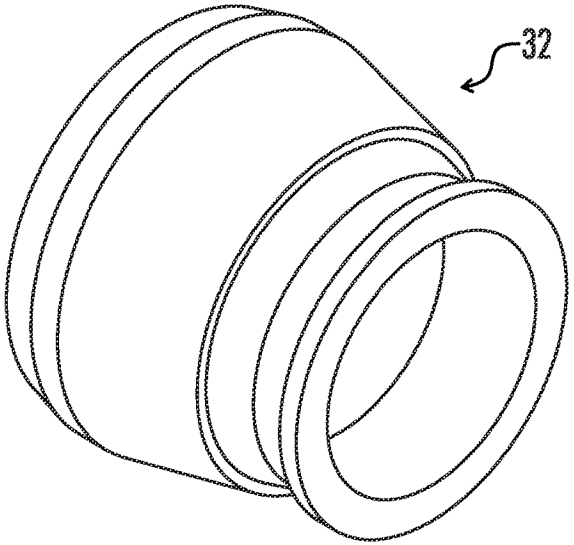
FIG. 5 is an isometric view of a cup seal 32 of frac plug 30.
Figure 6:
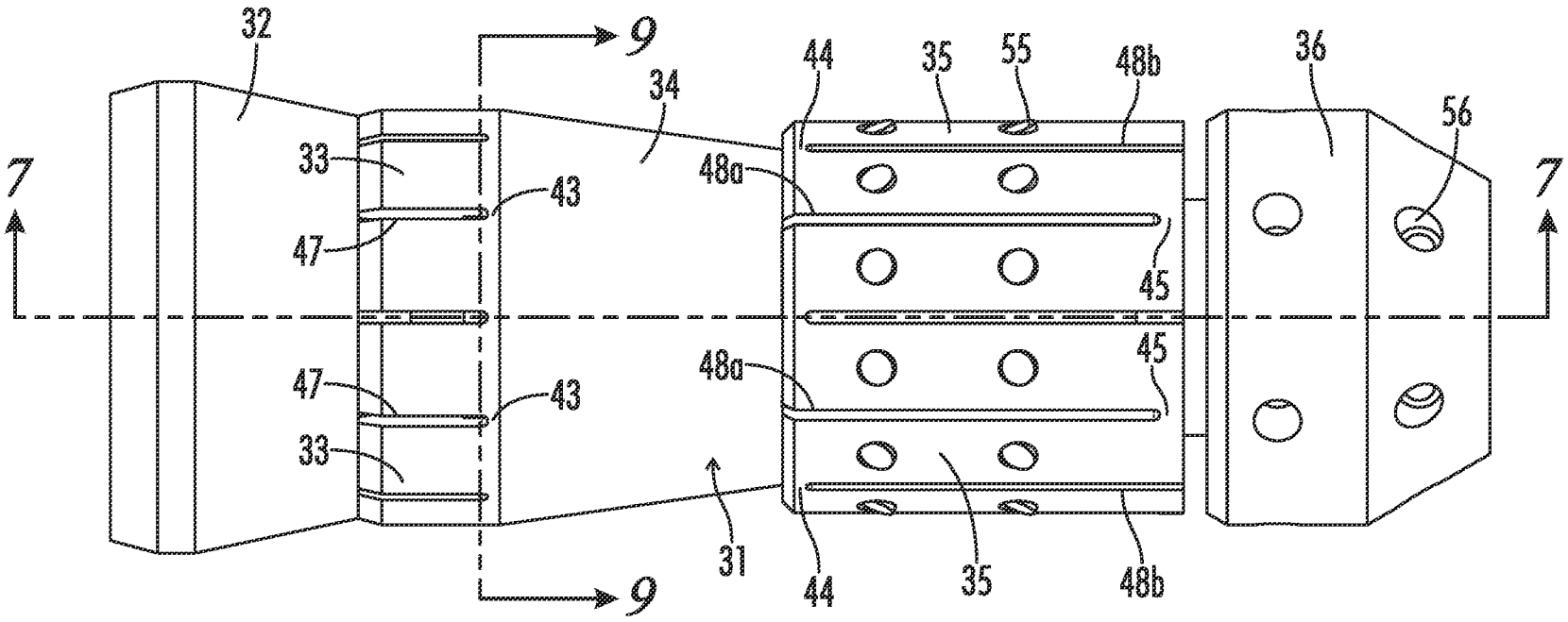
FIG. 6 is a side elevational view of frac plug 30 shown in FIG. 3, the upper end of frac plug 30 being on the left and the lower end being on the right.
Figure 7:
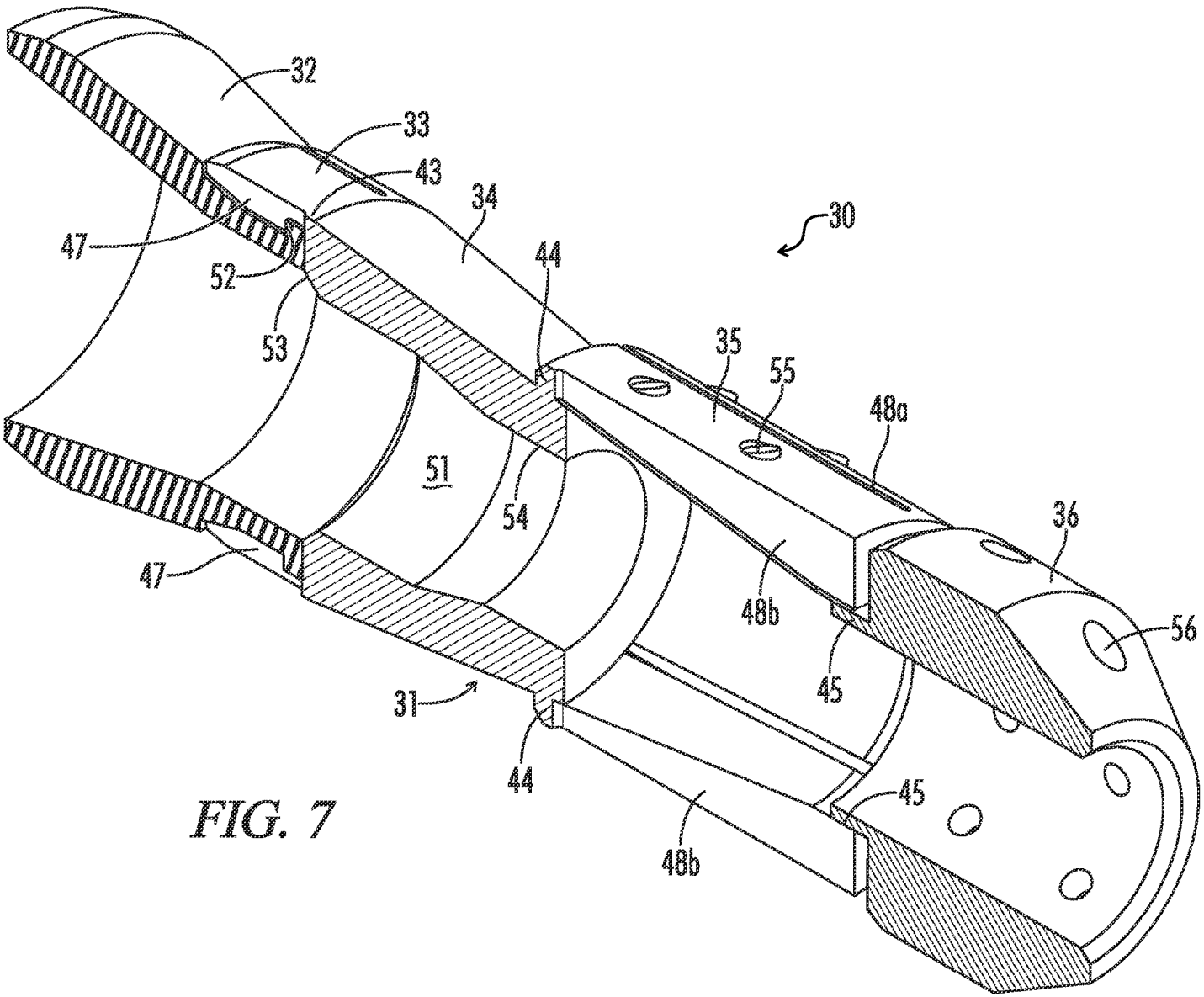
FIG. 7 is an isometric, axial cross-sectional view of frac plug 30 shown in FIGS. 3-4 and 6.

FIG. 2 illustrate schematically a conventional "plug and perf" job employing a first preferred embodiment 30 of the novel frac plugs. As shown in FIG. 2A, the upper portion of a well 1 is provided with a casing 3, while the lower portion is an open bore 4 extending generally horizontally through a hydrocarbon bearing formation 5.

A liner assembly 10 has been suspended from casing 3 by a liner hanger 11. Liner assembly 10 extends through open bore 4 and includes various tools, such as a "toe" or "initiator" valve 12 and a float assembly 13. Float assembly 13 typically includes various tools that assist in running liner 10 into well 1 and cementing it in bore 4, such as a landing collar 14, a float collar 15, and a float shoe 16.

Liner 10 has been cemented in bore 4 and the initial stage of a frac job has been completed. That is, cement 6 completely fills the annulus between liner 10 and bore 4. Toe valve 12, having been run in on liner 10 in its shut position, has been opened. Fluid has been pumped through a wellhead assembly 8, down liner 10, and into formation 5 via open toe valve 12. The fluid has created fractures 9 extending from toe valve 12 in a first zone near the bottom of well 1.

A typical frac job will proceed in stages from the lowermost zone in a well to the uppermost zone. Thus, FIG. 2A shows a "plug and perf" tool string 20 that has been run through wellhead assembly 8 and into liner 10 on a wireline 24. Tool string 20 comprises a perf gun 21, a setting tool 22, a setting tool adaptor 23, and a first novel frac plug 30*a*. Tool string 20 is positioned in liner 10 such that frac plug 30*a* is uphole from toe valve 12. Frac plug 30*a* is coupled to setting tool 22 by adaptor 23 and will be installed in liner 10 by actuating setting tool 22 via wireline 24. Once plug 30*a* has been installed, setting tool 22 and adaptor 23 will be released from plug 30*a*. Perf gun 21 then will be fired to create perforations 17*a* in liner 10 uphole from plug 30*a*. Perf gun 21 and setting tool 22 then will be pulled out of well 1 by wireline 24.

A frac ball (not shown) then will be deployed onto plug 30*a* to restrict the downward flow of fluids through plug 30*a*. Plug 30*a*, therefore, will substantially isolate the lower portion of well 1 and the first fractures 9 extending from toe valve 12. Fluid then can be pumped into liner 10 and forced out through perforations 17*a* to create fractures 9 (shown in FIG. 1B) in a second zone. After fractures 9 have been sufficiently developed, pumping is stopped and valves in wellhead assembly 8 will be closed to shut in the well 1. After a period of time, fluid will be allowed to flow out of fractures 9, through liner 10 and casing 3, to the surface.

Additional plugs 30*b* to 30*z* then will be run into well 1 and set, liner 10 will be perforated at perforations 17*b* to 17*z*, and well 1 will be fractured in succession as described above until, as shown in FIG. 2B, all stages of the frac job have been completed and fractures 9 have been established in all zones. Once the fracturing operation has been completed, plugs 30 typically will be removed from liner 10. Production equipment then will be installed in the well and at the surface to control production from well 1.

Frac Plug 30

A first embodiment 30 of the novel frac plugs is shown in greater detail in FIGS. 3-9. As may be seen therein, frac plug 30 generally comprises a plug body 31 and a cup seal 32. Plug body 31 has a profiled, somewhat elongated, generally open cylindrical shape. A central bore 51 extends axially through plug body 31. Bore 51 provides a conduit to allow fluids to flow through plug 30. As described further below, however, after plug 30 has been installed in liner 10, bore 51 may be plugged to shut off flow through plug 30 and isolate lower portions of liner 10 from fluids pumped into well 1.

Plug body 31 is a unitary or integral component having defined, separable elements joined by relatively weak bridging portions. The weak bridging portions are adapted to break in a controlled fashion and allow the elements to separate and self-assemble as plug body 31 is collapsed during setting of plug 30. That controlled breaking of the bridging portions and self-assembly process is described in detail below.

Preferably, as exemplified by plug 30, plug body 31 defines an array of seal backup elements 33, a wedge element 34, an array of slip elements 35, and a setting ring element 36. Backup elements 33 are bridged to wedge element 34 by an array of bridging portions 43. Wedge element 34 is bridged to slip element 35 by portions 44. Slip elements 35 are bridged to setting ring element 36 by portions 45. It will be appreciated from the discussion that follow that the geometry and dimensions of those bridging portions 43/44/45 provide them with significantly less shear strength along the axis of plug 30 and/or significantly less expansive hoop strength than possessed by the adjoining plug elements 33/34/35/36.

Seal backup elements 33 may be described in general terms as collectively having a generally annular or flattened ring shape. That collective shape is profiled, as described further below, to allow cup seal 32 to be assembled to plug body 31 and to provide backup for cup seal 32 while the well is being fractured. More specifically, bore 51 of plug body 31 has an annular groove 52 at the lower end, i.e., the downhole end of backup elements 33 adjacent the upper end, i.e., the uphole end of wedge element 34. The upper end of backup elements 33 has internal and external bevels. The lower end of cup seal 32 is profiled to fit within groove 52 and backup elements 33.

Backup elements 33 are breakaway elements designed to break apart into one or more separate backup segments, for example, as many as ten separate backup segments. Prior to installation, backup elements 33 are joined to each other and to wedge element 34 by weakened portions. For example, as seen best in FIGS. 3-5, individual backup elements 33 are largely, but not entirely separated by longitudinal slits 47. Slits 47 extend radially through the wall of plug body 31. They extend axially from the upper end of backup elements 33, through annular groove 52, and stop at the upper end of wedge element 34. Slits 47 leave relatively thin, weak bridging portions 43 joining each individual backup element 33 to wedge 34. When frac plug 30 is set and fluids are flowed into liner 10, as described further below, expansion of cup seal 32 will break bridging portions 43 allowing individual backup segments 33 to separate from each other and move radially outward.

Wedge element 34 is situated generally between backup elements 33 and slip elements 35. It may be described in general terms as having a generally tapered, annular or open cylindrical shape. Wedge element 34 is profiled, as described further below, to provide a bearing surface upon which adaptor 23 will bear as plug 30 is set, a ramping surface that will drive slip elements 35 radially outward into engagement with liner 10, and a seat 54 for a plug member.

More particularly, the upper portion of bore 51 extends through wedge element 34. Ball seat 54 is provided in wedge bore 51 by a shallow-angle, upward facing tapered reduction in its inner diameter. Ball seat 54 preferably is situated axially below the upper end of wedge element 34. More preferably, as seen best in FIG. 8, ball seat 54 is situated well below the upper end of wedge element 34, in its midsection. Thus, when plug 30 is set as described further below, ball seat 54 will be situated well below the axial midpoint of slips 35.

The outer surface of wedge element 34 in large part tapers radially inward from top to bottom. More specifically, the outer diameter of wedge element 34 decreases from at or near its upper end to at or near its lower end, thus providing wedge element 34 with a generally inverted truncated conical outer surface. As will be appreciated from the description below, when plug 30 is set, wedge element 34 will provide the structural core of plug 30.

Slip elements 35 are situated generally between wedge element 34 and setting ring element 36. They may be described in general terms as collectively forming a generally tapered annular or open cylindrical shape. That collective shape is profiled, as described further below, to provide a plurality of slips 35 that will engage liner 10 and anchor plug 30 therein.

More specifically, the outer surface of slip elements 35 is generally cylindrical, while the inner surface in large part tapers radially inward from top to bottom. That is, the inner diameter of slip elements 35 decreases from the upper end of slip elements 35 to proximate its lower end, thus providing the major portion of slip elements 35 with a generally inverted truncated conical inner surface. The tapered inner surface of slip elements 35 is generally complementary to the tapered outer surface of wedge element 34 in both its angle and length. The upper end of slip element 35 projects axially into, and overlaps a short distance over the outer surface of wedge element 34. A relatively short lower portion of slip elements 35 generally defines a substantially uniform, non-tapered inner diameter.

Like backup elements 33, slip elements 35 also are breakaway elements. They are designed to break apart into separate elements, for example, ten separate slips 35. Prior to installation, slip elements 35 are joined by weakened portions. For example, as seen best in FIGS. 3-5, individual slips 35 are largely, but not entirely separated by alternating, longitudinal sets of slits 48*a* and 48*b*. Slits 48 extend radially through the wall of plug body 31 except proximate wedge element 34 at the upper end of slip elements 35 and proximate setting ring 36 at the lower end of slip elements 35. They run axially through the major portion of slip elements 35. Slits 48*a* run from the upper end of slip elements 35 stopping proximate the lower end of slip elements 35. Slits 48*b* run from the lower end of slip elements 35 stopping proximate the upper end of slip elements 35.

Slip elements 35 overlap slightly at their upper end with wedge element 34 and at their lower end with setting ring element 36. That slight overlap, along with slits 48*a* and 48*b* leave relatively thin, weak bridging portions 44 along the upper end of slip elements 35 and bridging portions 45 along the lower end of slip elements 35. Upper bridging portions 44 join slip elements 35 to wedge 34 and join adjacent slip elements 35 together. Lower bridging portions 45 join slip elements 35 to setting ring element 36 and join adjacent slip elements 35 together. When frac plug 30 is installed, as described further below, bridging portions 44 and 45 will break allowing individual slip elements 35 to separate from each other and move axially over wedge element 34 and radially outward into contact with liner 10.

The outer surface of slip elements 35 preferably is provided with features to assist slip elements 35 in engaging and gripping liner 10 when frac plug 30 is set. Thus, for example, slip elements 35 may be provided with high-strength or hardened particles, grit, or inserts, such as buttons 55. Buttons 55 may be mounted in suitable bottomed holes in the outer surface of slip elements 35. They may be fabricated from, for example, a ceramic material containing aluminum, such as a fused alumina or sintered bauxite, or zirconia, such as CeramaZirc available from Precision Ceramics. Buttons 55 also may be fabricated from heat treated steel or cast iron, fused or sintered metals and other high-strength materials, or carbides such as tungsten carbide. The precise number and arrangement of buttons 55 or other such components may be varied. The outer surface of slip elements 35 also may be provided with teeth or serrations in addition to or in lieu of buttons or other gripping features.

Setting ring element 36 is situated generally below slip elements 35 at the lower end of plug body 31. As noted above, it is joined to slip elements 35 by bridging portions 45. It has a generally annular or open cylindrical shape that is profiled, as described further below, to allow setting ring element 36 to cooperate with a setting tool in setting plug 30 and to protect plug 30 as it is am into liner 10.

More specifically, the upper end of setting ring 36 has a dramatically reduced outer diameter, that lower diameter being somewhat less than the inner diameter of the lower end of slip elements 35. Thus, the upper portion of setting ring element 36 forms a short, thin annular nipple extending axially from the main portion of setting ring element 36 into the lower end of slip elements 35.

Setting ring element 36 also has radial openings 56 extending through the walls of its main, lower portion. Radial openings 56 allow setting ring element 36 to be releasably connected to adaptor 23 by, for example, shear screws, shear pins, or other shearable connectors (not shown). The shearable connectors will allow frac plug 30 to separate from adaptor 23 and setting tool 22 once it is set.

The lower end or "nose" of setting ring element 36 has an annular bevel or taper that assists in guiding plug 30 as it is deployed through liner 10. The outer surface of setting ring element 36 also has a maximum diameter portion in its mid-section. The maximum diameter portion of setting ring element 36 preferably has a diameter somewhat greater than the outer diameter of backup elements 33, wedge element 34, and slip elements 35. Setting ring element 36 thus can serve as a gauge ring and can protect the upper elements of plug body 31, especially slip element 35, from catching on debris, protrusions, and the like that might cause them to deploy prematurely as plug 30 is run into position in liner 10. In addition, adaptor 23 connecting setting tool 22 and plug 30 will comprise a protective tube or sheath into which the upper end of cup seal 32 may be carried in a somewhat compressed state. The seal sheath may provide an additional gauge surface. In any event, it will protect cup seal 32 from damage and prevent it from hanging up as frac plug 30 is deployed.

Plug 30 may be deployed and installed in a well by coupling it to a wireline tool string, such as tool string 20 on wireline 24. In general, wedge element 34 will be driven into slip elements 35 forcing them to expand radially into gripping contact with liner 10. More specifically, once plug 30 is deployed to the desired location in liner 10, setting tool 22 will be actuated to generate a force linearly compressing plug 30 along its major axis.

Figure 8A:
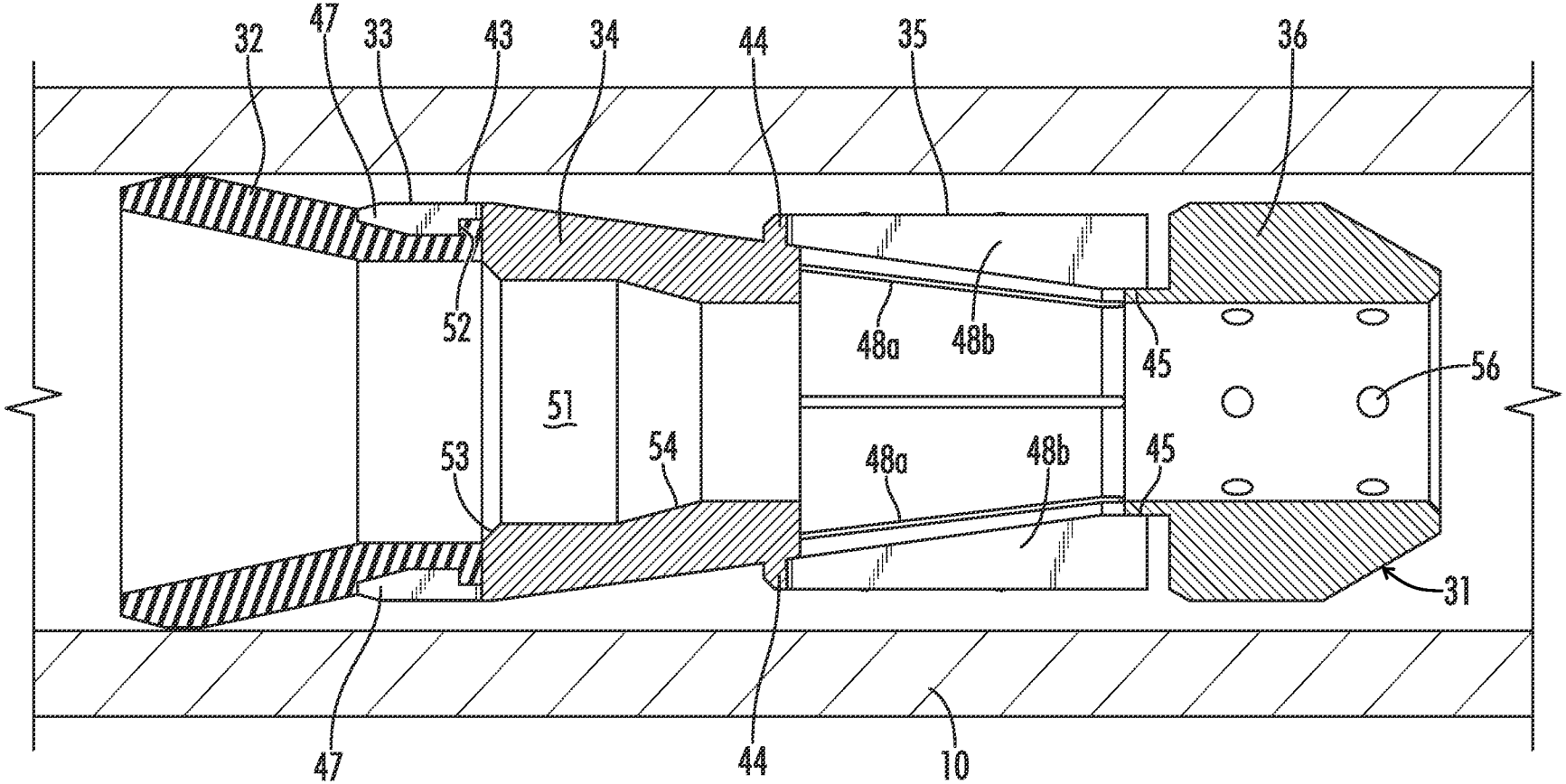
FIG. 8A is an axial, cross-sectional view of frac plug 30 shown in FIGS. 3-4, which view shows frac plug 30 in its unset state in liner 10.
Figure 8B:
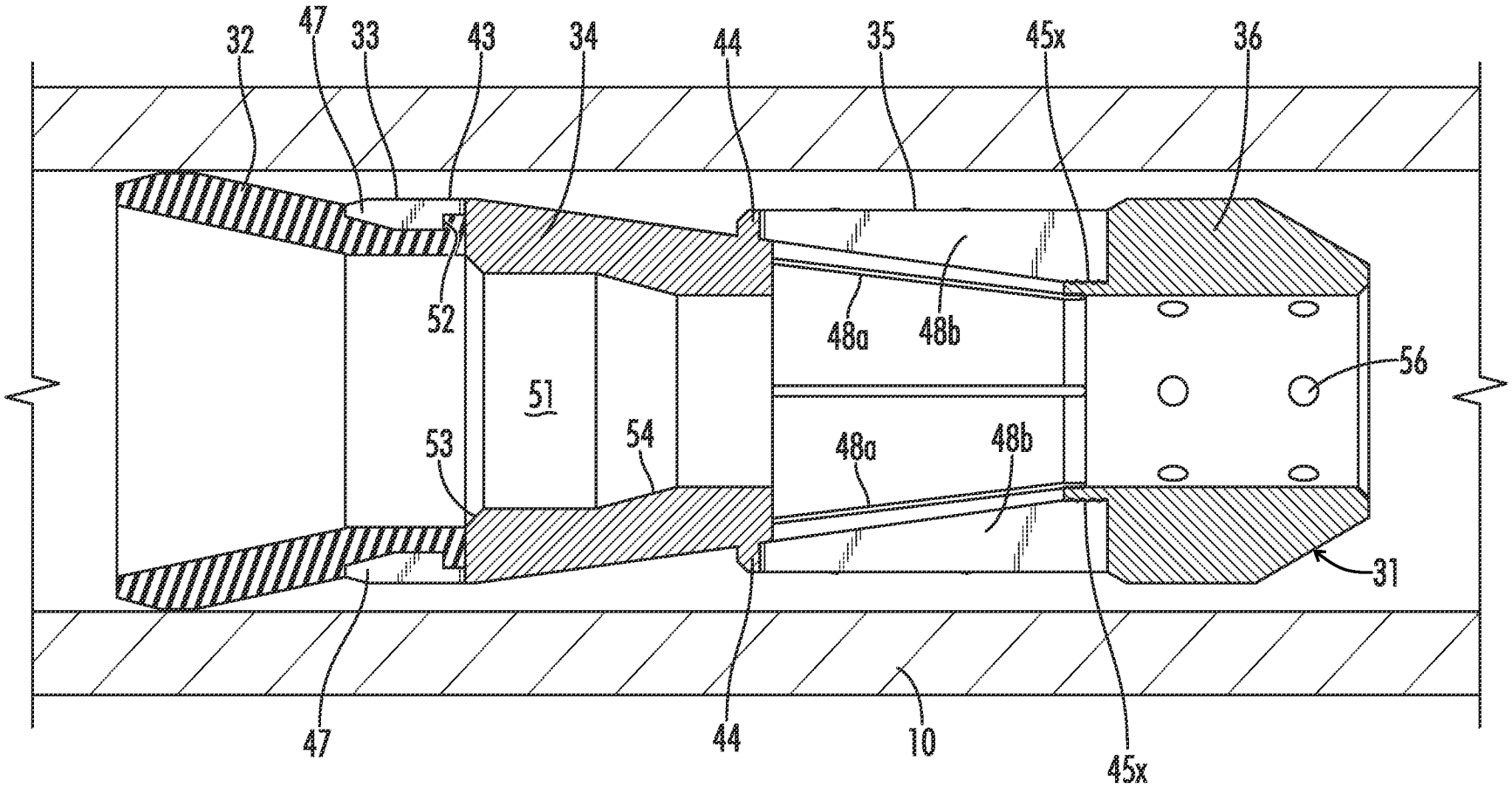
FIG. 8B is an axial, cross-sectional view of frac plug 30 in a partially set state.

The axial, compressive force will be transmitted through adaptor 23 and applied between wedge element 34 and setting ring element 36 of plug 30. A downward force will bear on an upper surface of wedge element 34, such as an annular beveled surface 53 at the upper end of wedge element 34. An upward force will be transmitted to setting ring element 36. Once a predetermined level of compressive force is generated by setting tool 22, the connection between slip elements 35 and setting ring 36 provided by bridging portions 45 will break, allowing those elements 35/36 to separate. For example, bridging portions 45 may shear generally along an annular plane aligned with the lower, inner cylindrical surface of slip elements 35 and the upper, outer cylindrical surface of setting ring 36. The nipple at the upper end of setting ring 36 then will shift upward into the lower end of slip elements 35 as shown in FIG. 8B. That shift allows the upward-facing shoulder formed by the enlarged diameter portion of setting ring 36 to butt against the lower surface of slip elements 35.

As increasing axial compressive force is generated by setting tool 22, the connection between wedge element 34 and slip elements 35 provided by bridging portions 44 will break, allowing wedge 34 to be driven downward into the bore of slip elements 35. For example, bridging portions 44 may shear generally along an annular plane aligned with the outer tapered surface of wedge 34 and the inner tapered surface of slip elements 35. As wedge 34 travels axially downward, the complementary conical surfaces on wedge 34 and slips 35 allow wedge 34 to ride under slip elements 35.

Figure 8C:
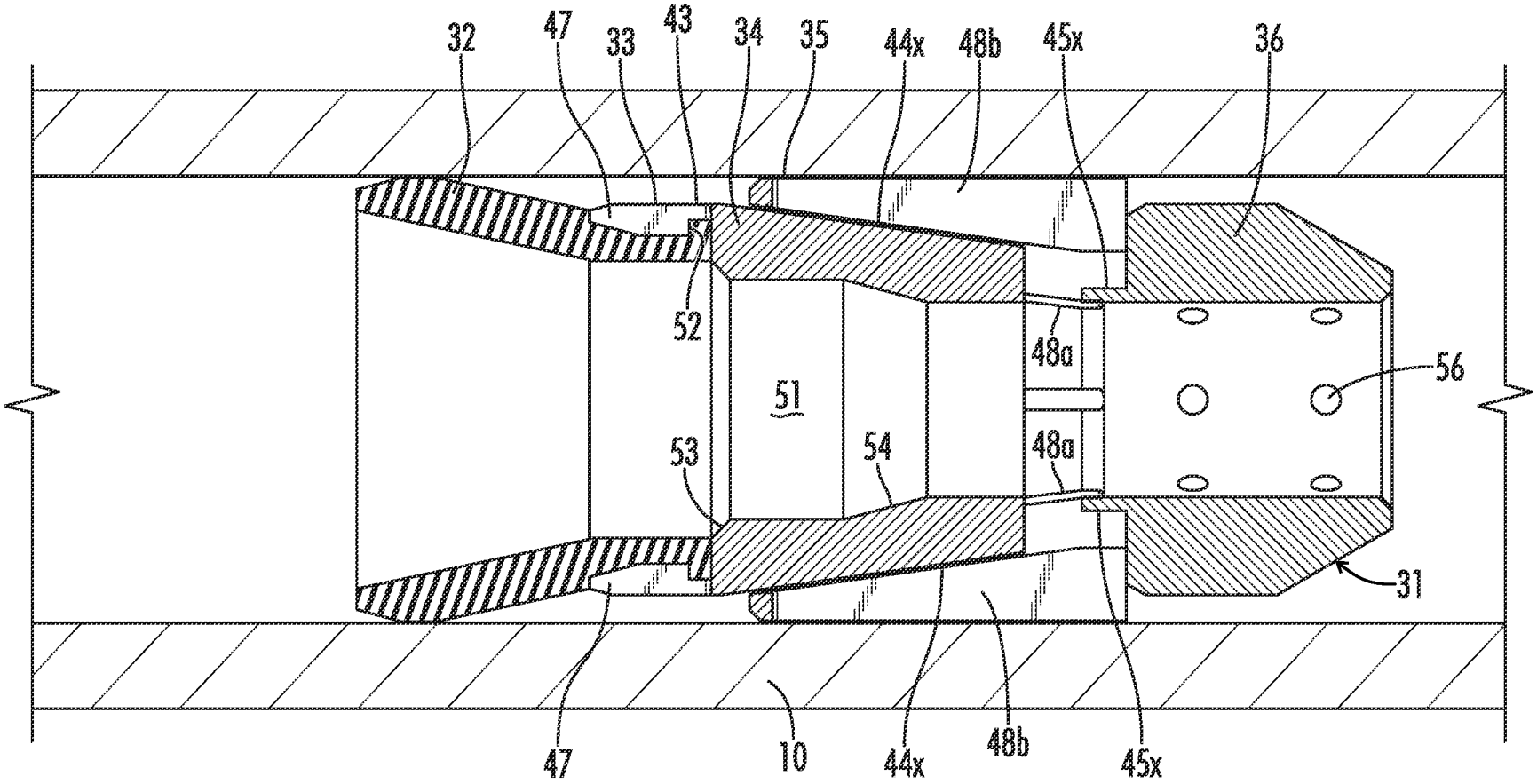
FIG. 8C is an axial, cross-sectional view of frac plug 30 in its set state.

As wedge 34 continues downward, it generates radial load on slip elements 35. The connections between adjacent slip elements 35 provided by bridging portions 44 and 45 will break, allowing slip elements 35 to separate from each other. For example, slip elements 35 may separate along burst lines generally aligned with slits 48*a* and 48*b* and extending through bridging portions 44 and 45. Ideally, each slip element 35 will separate completely, but as a practical matter, some slip elements 35 may remain connected to other slip elements 35. In any event, as shown in FIG. 8C, separated slips 35 eventually will move radially outward into contact with liner 10 such that slips 35 and wedge 34 largely overlap.

Thus jammed between the outer conical surface of wedge 34 and liner 10, slips 35 are able to anchor plug 30 within liner 10. Preferably, the taper angles will be such that wedge 34 and slips 10 are self-locking. Thus, for example, when plug body 31 is fabricated from a composite, such as a wound fiber resin blank, the tapered outer surface of wedge 35 and the tapered inner surface of slips 35 are provided with a taper from about 1° to about 10° off center so as to provide a self-locking taper fit between them.

As noted above, setting tool 22 is connected through adaptor 23 to setting ring 36 by shearable connectors (not shown). When wedge 34 has been fully driven into slips 35, they will have been shifted radially outward into contact with liner 10. At that point, the shear forces across the shearable connectors will increase rapidly. When those forces exceed a predetermined limit, the connectors will shear, relieving any further compressive force on plug 30. Shearing of the connectors also releases setting tool 22 from setting ring 36. Setting tool 22 then can be pulled out of plug 30 and liner 10 via wireline 24.

Figure 8D:
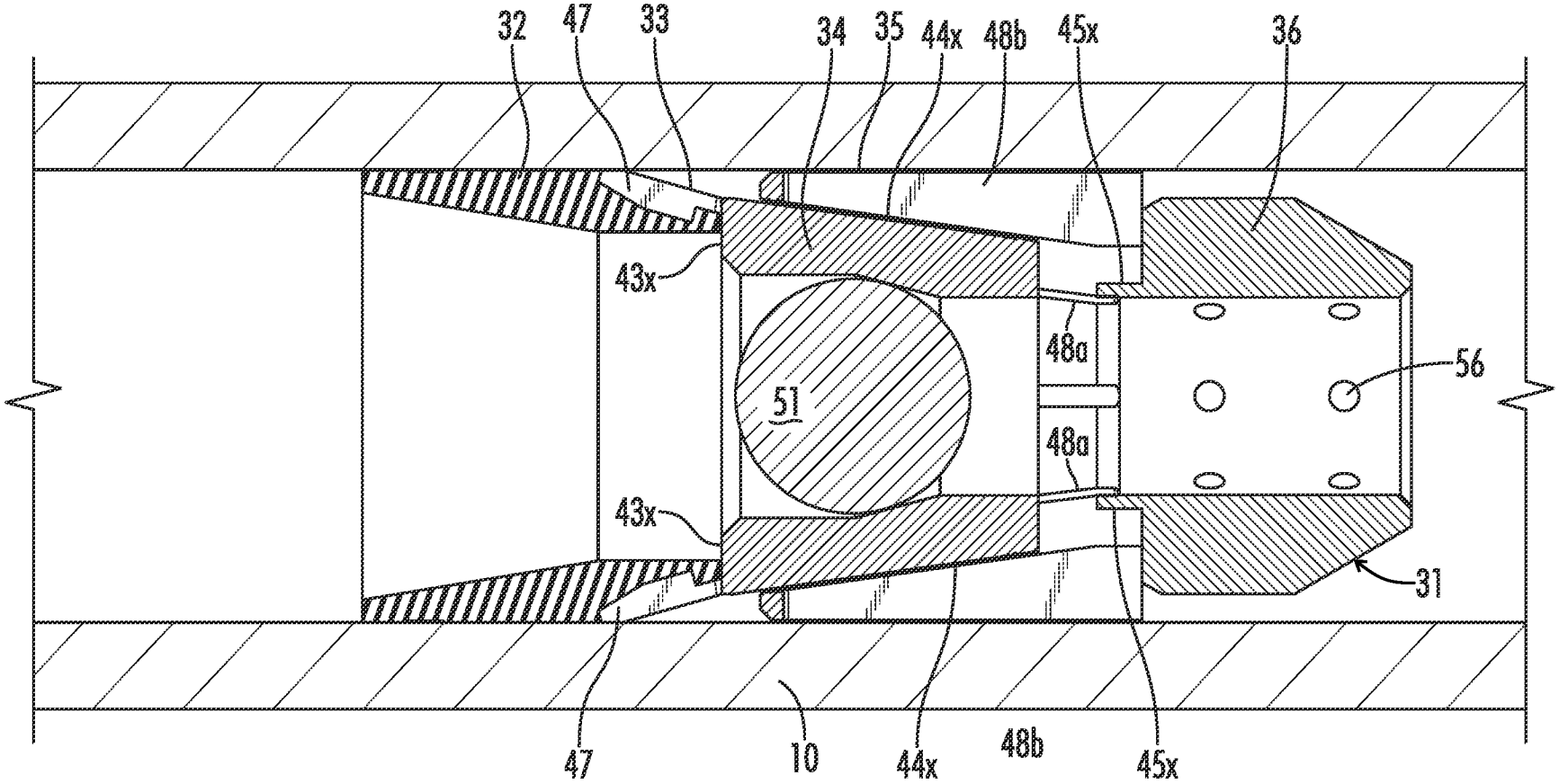
FIG. 8D is an axial, cross-sectional view of frac plug 30 in its set, pressurized state.
Figure 9:
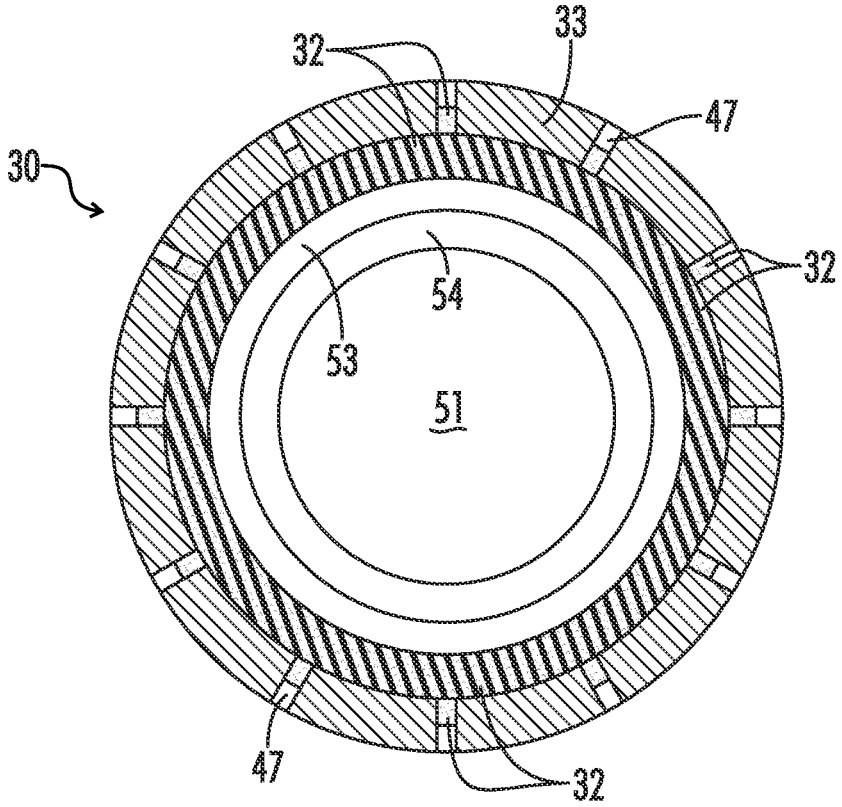
FIG. 9 is a radial, cross-sectional view of frac plug 30 taken generally across the lower end of cup seal 32.
Figure 10:
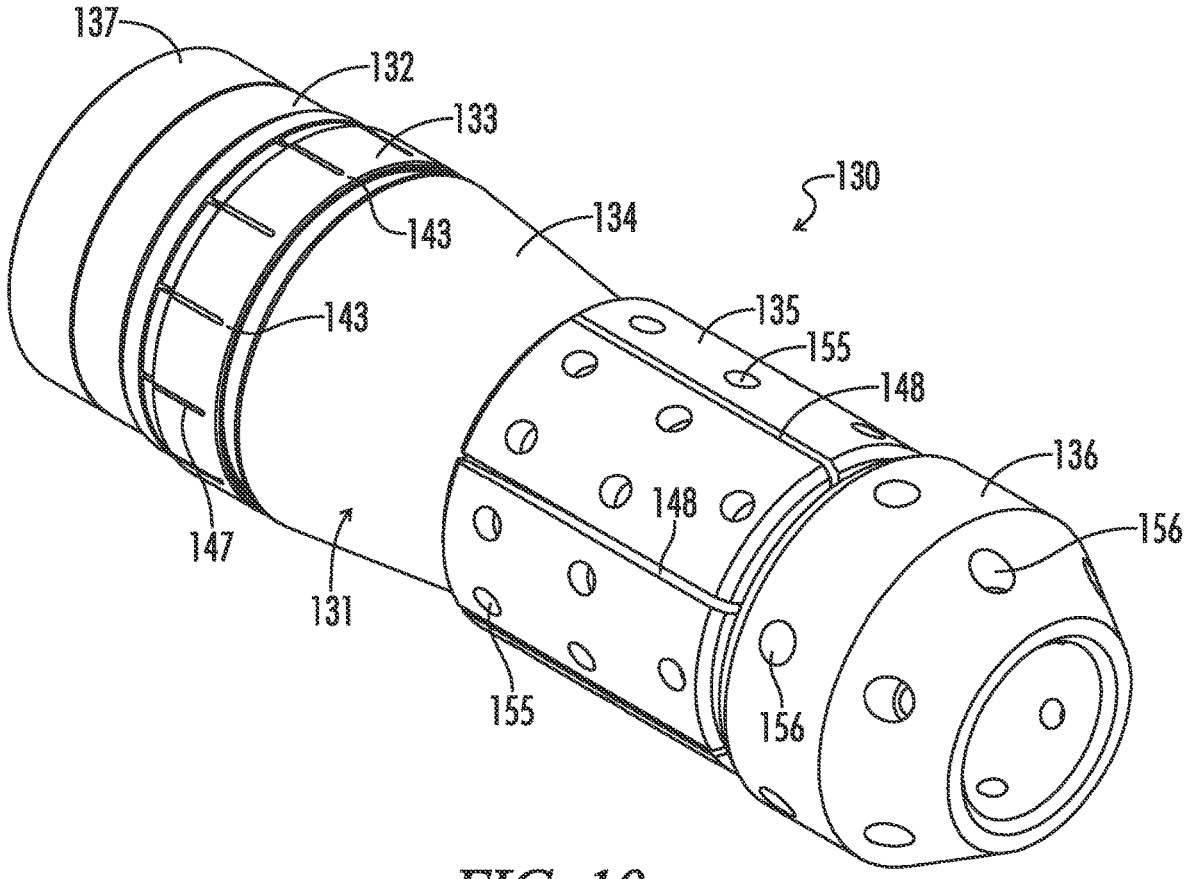
FIG. 10 is an isometric view, taken from an angle as in FIG. 3, of a second preferred embodiment 130 of the novel frac plugs of the subject invention.
Figure 11:
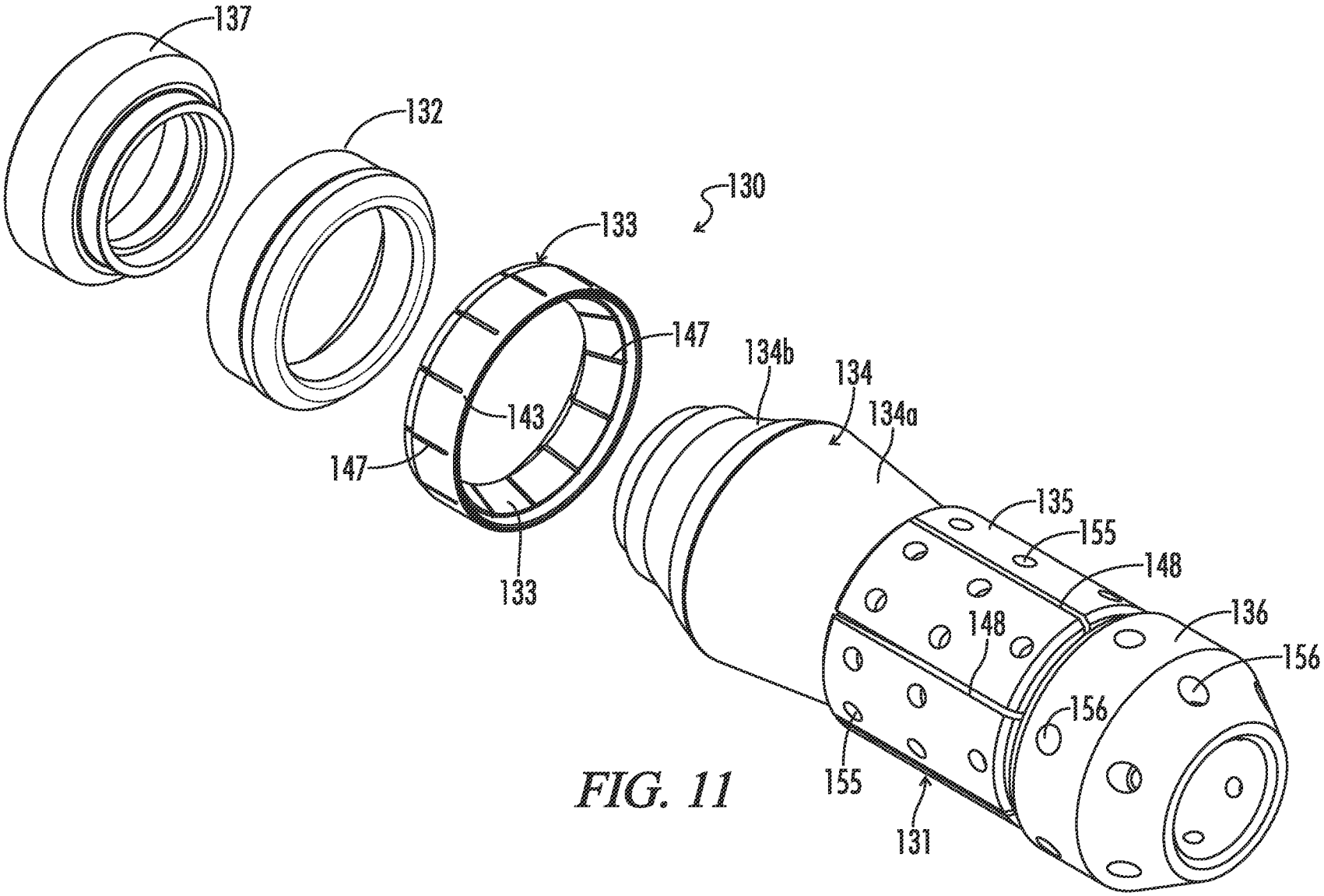
FIG. 11 is an exploded isometric view of frac plug 130 shown in FIG. 10, showing the components thereof in isometric views.
Figure 12:
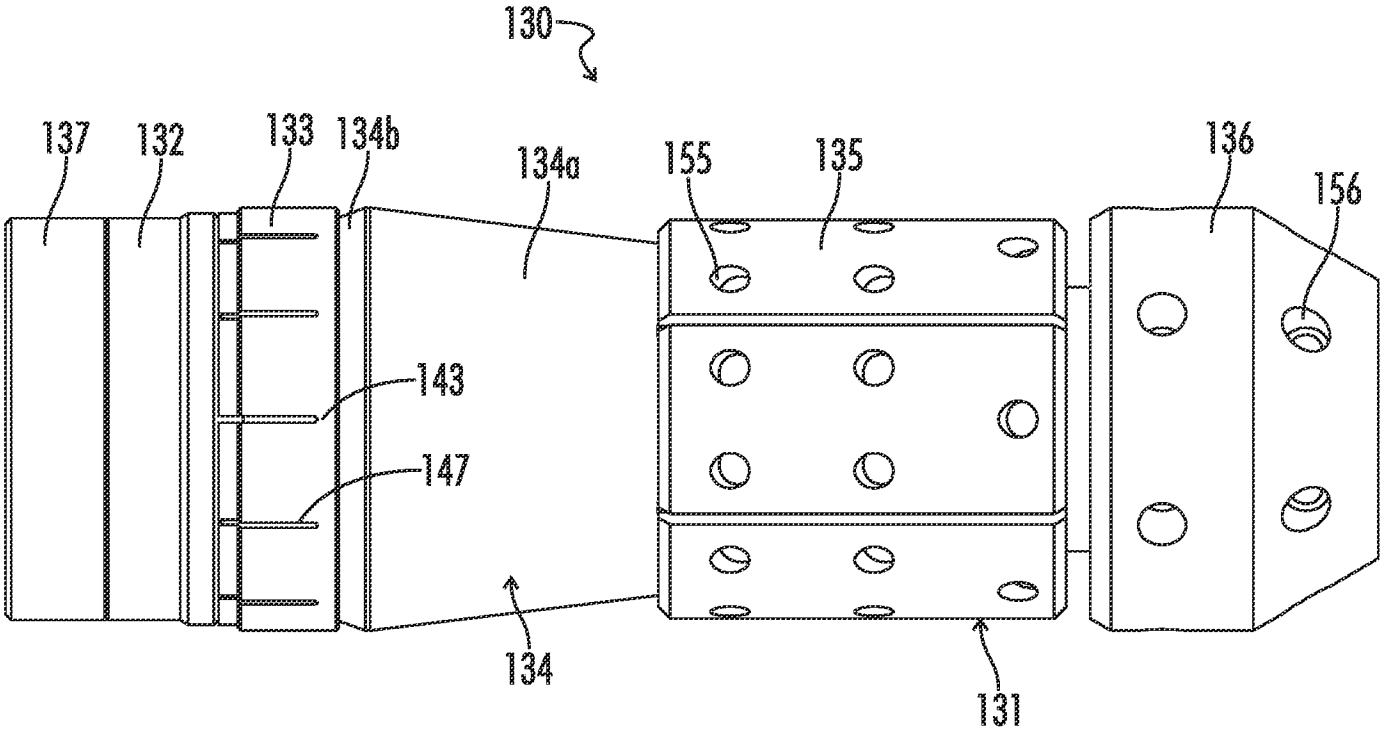
FIG. 12 is a side elevational view of frac plug 130 shown in FIGS. 10-11, the upper end of frac plug 130 being on the left and the lower end being on the right.
Figure 13:
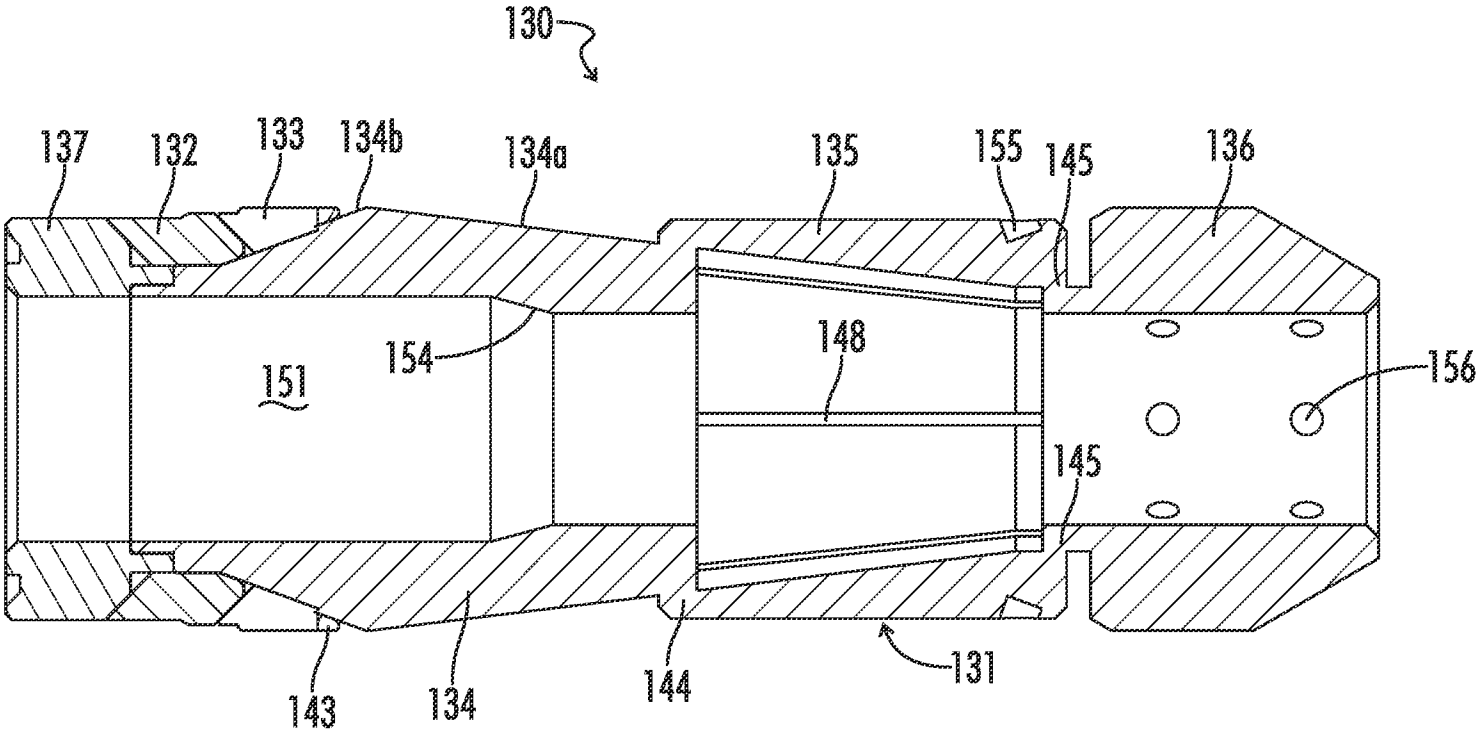
FIG. 13 is an axial, cross-sectional view of frac plug 130.
Figure 14:
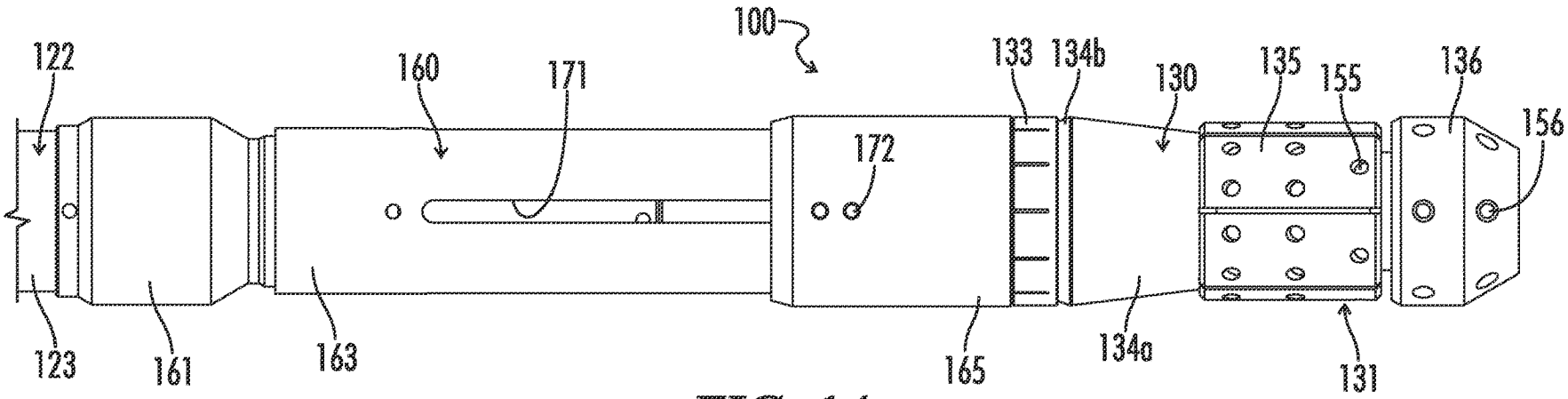
FIG. 14 is a side elevational view of a first preferred embodiment 100 of the novel tool assemblies of the subject invention, tool assembly 100 comprising novel frac plug 130 and a first preferred embodiment 160 of the novel setting tool adaptors of the subject invention.

Plug 30 then will be fully installed as depicted schematically in FIG. 1B and will be ready to receive a frac ball (not shown in FIG. 1B). Once deployed, the frac ball will land on seat 54 in bore 51 of wedge 34 as shown in FIG. 8D. Seat 54 has a beveled surface that allows the ball to substantially restrict or preferably to shut off entirely fluid flow through plug 30. Preferably, seat 54 is located in wedge 34 such that, when plug 30 is installed and wedge 34 is fully inserted into slips 35, seat 54 will be positioned between the upper and lower ends of slips 35, and more preferably, well below the axial midpoint of slips 35. When fluid pressure is generated above the frac ball, therefore, it will create radial load on wedge 34 and slips 35. That radial load will further support the engagement between slips 35 and liner 10 and allow the use of softer materials, such as composites, having relatively lower radial yield strengths.

Cup seal 32 has a generally annular or open cylindrical shape. Its lower portion is provided with an annular lip or flange. The flange extends into the annular groove in the lower end of seal backup elements 33 and may be secured therein by suitable adhesives. The inner surface of the upper portion of cup seal 32 tapers radially inward. The upper end of cup seal 32, therefore, flares radially outward such that when plug 30 in installed, it will contact liner 10 under some compression. A section of cup seal 32 near its upper end has a uniform outer diameter, thus providing an extended contact surface. After installation, but before pumping frac fluids into well 1, cup seal 32 provides a light seal between frac plug 30 and liner 10.

Once pumping commences, however, increasing fluid pressure above frac plug 30 will cause cup seal 32 to "balloon" out, swelling it into an increasingly more robust seal with liner 10. Frac fluid will be unable to flow past frac plug 30 and will be diverted through perforations in liner 10 to create fractures 9.

As cup seal 32 balloons out, the fluid pressure within cup seal 32 will break bridging portions 43 between backup elements 33 and wedge 34. The fluid pressure, for example, will apply load to bridging portions 43, including load in an outward radial direction. That radial load will break the connections between individual backup elements 33, for example, along longitudinal burst lines. Ideally, each backup element 33 will separate completely, but as a practical matter, some backup elements 33 may remain connected to other backup elements 33. In any event, as shown in FIG. 8D, backup segments 33 then will be pushed radially outward into contact with liner 10 and into a position where they will impede downward extrusion of cup seal 32. Bridging portions 43, to the extent they connect individual backup elements 33 to wedge element 34, preferably will not break entirely, but will allow the uphole end of backup elements 33 to pivot radially outward into contact with liner 10. If there is complete separation between backup elements 33 and wedge element 34, however, groove 52 provides a downward facing shoulder that can catch on the upper end of wedge 34, providing a stop to limit downward shifting of backup elements 33 a cup seal 32 is pressurized.

It will be appreciated that novel plug 30 and other embodiments having a unitary or integral plug body that comprises defined, separable elements joined by relatively weak bridging portions offer significant advantages over prior art plugs. The weak bridging portions are adapted to break in a controlled sequence and allow the elements to separate and self-assemble as the plug body is collapsed during installation of the plug.

For example, the wedge element and slip elements are joined by weak bridging portions. The design specifications of the wedge and slip elements may be more precisely matched and controlled more easily than when those components are fabricated as separate components. Thus, it is more likely that the strength of engagement with the liner will be more uniform from slip to slip. The controlled breaking and self-assembly also allows more precise control over the sequence and timing of setting of the slips, even when the plug is made of softer materials such as composites. It is believed, therefore, that the novel plugs will be anchored more reliably and securely than prior art plugs, especially those fabricated from composites.

Frac Plug 130 and Setting Tool Adaptor 160

A second preferred embodiment 130 of the novel frac plugs is shown in greater detail in FIGS. 10-15. As may be seen most easily in the exploded view of FIG. 11, frac plug 130 generally comprises a plug body 131, a cup seal 132, a seal backup ring 133, and a thrust ring 137. Plug body 131 is similar in many respects to plug body 31 of plug 30. It has a profiled, somewhat elongated, generally open cylindrical shape. A central bore 151 extends axially through plug body 131.

Plug body 131, like plug body 31 of novel plug 30, is an integral component having defined elements joined by relatively weak bridging portions. As in plug 30, the weak bridging portions are adapted to break in a controlled fashion and allow the elements to separate and self-assemble as plug body 131 is collapsed during setting of plug 130.

Preferably, as exemplified by plug 130, plug body 131 defines a wedge element 134, an array of slip elements 135, and a setting ring element 136. As seen best in FIG. 12, wedge element 134 is bridged to slip element 135 by portions 144. Slip elements 135 are bridged to setting ring element 136 by portions 145. It will be appreciated from the discussion that follow that the geometry and dimensions of those bridging portions 144/145 provide them with significantly less shear strength along the axis of plug 130 than possessed by the adjoining plug elements 134/135/136.

Wedge element 134 generally comprises the upper portion of plug body 131 and is situated above slip elements 135. It may be described in general terms as having an annular or open cylindrical shape with two tapered surfaces as best appreciated from the cross-sectional view of FIG. 12. Wedge element 134 is profiled, as described further below, to provide a lower ramping surface 134*a* that will drive slip elements 135 radially outward into engagement with liner 10, an upper ramping surface 134*b* that will drive cup seal 132 and seal backup ring 133 radially outward to provide a reinforced seal with liner 10, and a seat 154 for a plug member.

Ball seat 154 is provided in wedge bore 151 by a shallow-angle, upward facing tapered reduction in its inner diameter. Ball seat 154 preferably is situated axially below the upper end of wedge element 134. More preferably, as seen best in FIG. 13, ball seat 154 is situated well below the upper end of lower ramping surface 134*a* of wedge element 134, in its midsection. Thus, when plug 130 is set as described further below, ball seat 154 will be situated well below the axial midpoint of slips 135.

The outer surface of wedge element 134 in large part comprises lower ramping surface 134*a* and upper ramping surface 134*b*. Lower ramping surface 134*a* tapers radially inward from top to bottom. More specifically, the outer diameter of wedge element 134 decreases from the upper end of ramping surface 134*a* to the lower end thereof. Upper ramping surface 134*b* tapers radially inward from bottom to top. That is, the outer diameter of wedge element 134 decreases from the lower end of ramping surface 134*b* to the upper end thereof. Thus, wedge element 134 is provided with two truncated conical surfaces. One, lower ramping surface 134*a*, is inverted and faces downward. The other, upper ramping surface 134*b*, faces upward. As will be appreciated from the description below, when plug 130 is set, wedge element 134 will provide the structural core of plug 130.

Slip elements 135 are situated generally between wedge element 134 and setting ring element 136. Slip elements 135 are substantially similar to slip elements 35 of plug 30. Thus, they may be described in general terms as collectively forming a generally tapered annular or open cylindrical shape. That collective shape is profiled, as described further below, to provide a plurality of slips 135 that will engage liner 10 and anchor plug 130 therein.

More specifically, the outer surface of slip elements 135 is generally cylindrical, while the inner surface in large part tapers radially inward from top to bottom. The tapered inner surface of slip elements 135 is generally complementary to lower ramping surface 134*a* of wedge element 134 in both its angle and length. Like slip elements 35, slip elements 135 also are breakaway elements designed to break apart into separate slips 135.

Prior to installation, slip elements 135 are joined by weakened portions. For example, individual slip elements 135 are largely separated by longitudinal slits 148, but they overlap slightly at their upper end with wedge element 134 and at their lower end with setting ring 136. Those slight overlaps leave relatively thin, weak bridging portions 144 along the upper end of slip elements 135 and bridging portions 145 along the lower end of slip elements 135. Upper bridging portions 144 join slip elements 135 to wedge 134 and join the upper ends of adjacent slip elements 135 together. Lower bridging portions 145 join slip elements 135 to setting ring element 136 and join the lower ends of adjacent slip elements 135 together. When frac plug 130 is set, as described further below, bridging portions 144 and 145 will break allowing individual slip elements 135 to separate from each other and move axially over wedge element 134 and radially outward into contact with liner 10.

The outer surface of slip elements 135 preferably is provided with features to assist slip elements 135 in engaging and gripping liner 10 when frac plug 130 is set. For example, as with slip elements 35 of plug 30 and seen best in the isometric views of FIG. 10-11, they may be provided with high-strength or hardened particles, grit, or inserts, such as buttons that may be mounted in bottomed holes 155. The outer surface of slip elements 135 also may be provided with teeth or serrations in addition to or in lieu of buttons or other gripping features.

Setting ring element 136 is substantially identical to setting ring element 36 of plug 30 and is situated generally below slip elements 135 at the lower end of plug body 131. As noted above, it is joined to slip elements 135 by bridging portions 145. The upper portion of setting ring element 136 forms a short, thin annular nipple extending axially from the main portion of setting ring element 136 into the lower end of slip elements 135. The lower end or "nose" of setting ring element 136 has an annular bevel or taper that assists in guiding plug 130 as it is deployed through liner 10. The outer surface of setting ring element 136 also has a maximum diameter portion in its mid-section that preferably allows setting ring element 136 to serve as a protective gauge ring.

Cup seal 132, seal backup ring 133, and thrust ring 137, as described further below, cooperate to provide a pressure seal between liner 10 and plug 130. As best appreciated by comparing FIGS. 11 and 13, thrust ring 137 has a generally annular, ring shape having a profiled, but generally trapezoidal cross-section. It is coupled to the upper end of plug body 131 and its lower end abuts cup seal 132. For example, thrust ring 137 may be provided with a downward extending annular rim that extends around and engages an upward extending rim on the upper end of plug body 131. The upper face of thrust ring 137 preferably is provided with a profile, such as an annular notch, that facilitates axial engagement with an adaptor kit 160 as described further below. The lower end of the outer surface of thrust ring 137 has a bevel that provides a downward facing, inward taper that abuts the upper face of cup seal 132. The bevel will provide a ramping surface to radially expand cup seal 132 as plug 130 is set.

Cup seal 132 is carried in part on upper ramping surface **134*b* of plug body 131 and in part on thrust ring 137. It has a generally annular, ring shape also having a profiled, but generally trapezoidal cross-section. The lower portion of its inner surface is beveled to provide cup seal 132 with a downward facing, outwardly tapered surface that is complimentary to the upward facing taper of upper ramping surface 1341. The lower portion of its outer surface is beveled to provide another downward facing tapered surface which engages seal backup ring 133. Upper face of cup seal 132 is beveled to provide an upward facing, inward taper on cup seal 132 that is generally complimentary to the downward facing taper on thrust ring 137**.

Seal backup ring 133 is carried on upper ramping surface **134*b* of plug body 131. It may be described in general terms as collectively having a generally annular or ring shape with a generally triangular cross-section. Equivalently, the lower and upper faces of seal backup ring 133 may be viewed as beveled. Backup ring 132 thus is provided with a downward facing taper at its lower end that is complimentary to the upward facing tapered surface 134*b* on wedge 134 and an upward facing taper at its upper end that is complimentary to the outer, downward facing taper on cup seal 132**.

Seal backup ring 133 comprises breakaway elements designed to break apart into separate backup segments, for example, ten separate backup segments 133. Prior to installation, backup elements 133 are joined by weakened portions. For example, as seen best in FIGS. 10-12, individual backup elements 133 are largely, but not entirely separated by longitudinal slits 147. Slits 147 extend radially through seal backup ring 133. They extend axially from the upper end of seal backup ring 133 and stop proximate the lower end of seal backup ring 133. Slits 147 leave relatively thin, weak bridging portions 143 joining each individual backup element 133 in seal backup ring 133. When frac plug 130 is set, as described further below, radial expansion of seal backup ring 133 will break bridging portions 143 allowing individual backup segments 133 to break away and move radially outward.

Plug 130 may be deployed and installed in a well as described above in reference to plug 30. Plug 130, for example, preferably will be installed by a first preferred embodiment 100 of the novel tool assemblies. Tool assembly 100 will be coupled to wireline, such as wireline 24 shown schematically in FIG. 2A. As may be seen in FIGS. 14-15, tool assembly 100 also is coupled to plug 130 and generally comprises a setting tool 122 and a first preferred embodiment 160 of the novel setting tool adaptors. Once plug 130 is deployed to the desired location in liner 10, setting tool 122 will be actuated to generate axial compressive forces that will be transmitted through adaptor 160 to plug 130, The compressive forces will be applied between thrust ring 137 and setting ring element 136 to linearly compress plug 130 along its major axis. As described in further detail below, lower ramping surface **134*a* of wedge element 134 of plug 130 will be driven into slip elements 135 forcing them to expand radially into gripping contact with liner 10. Cup seal 132 will be driven up upper ramping surface 134*b* of wedge element 134 to seal plug 130 in liner 10**.

A variety of setting tools and adapter kits may be used to install the novel plugs. For example, setting tool 122 is a pyrotechnic "Baker Style" setting tool similar to the E-4 series pyrotechnic setting tools sold by Baker Hughes. It has combustible powder charges which are electrically ignited through a wireline. Ignition of the charges generates pressure that will actuate the tool. Other pyrotechnic setting tools, however, may be used, such as the Compact wireline setting tools sold by Owen Oil Tools, the GO-style setting tools available from The Wahl Company, and the Shorty series tools available from Halliburton. Disposable setting tools, such as the DB10 and DB20 setting tools available from Diamondback Industries, also may be used. Likewise, other types of setting tools may be used. For example, electrohydraulic setting tools, such as Weatherford's DPST setting tool, may be used. Hydraulic setting tools, such as Schlumberger's Model E setting tool, or ball activated hydraulic setting tools, such as Weatherford's HST setting tool and American Completion Tools Fury 20 setting tools, also may be used. If hydraulic setting tools are used, the tools will be run in a coiled tubing or a pipe string.

Details of the construction and operation of such setting tools are well known in the art and will not be expounded upon. Suffice it to say, however, that setting tool 122 includes an activatable outer push drive 123 and an activatable inner pull drive 124, as may be seen in FIG. 15. When setting tool 122 is actuated, outer push drive 123 moves downward relative to inner pull drive 124 transmitting axial, compressive force through adapter 160 to plug 130.

Likewise, various adaptor kits may be used with the novel plugs, the specific design of which will be tailored to a particular setting tool. The novel adaptors have an outer push member adapted for releasable connection to the plug, an inner pull member adapted for releasable connection to the plug, and a seal sheath. The seal sheath is coupled to the inner pull member by a connector extending through the outer push member. When the tool is connected to the plug in an unset position, the seal sheath is in a first position extending annularly around and substantially covering the outer surface of the plug seal. When the inner pull member moves upward relative to the outer push member, it moves the seal sheath from the first position covering the seal to a second position uncovering the seal.

Figure 15:
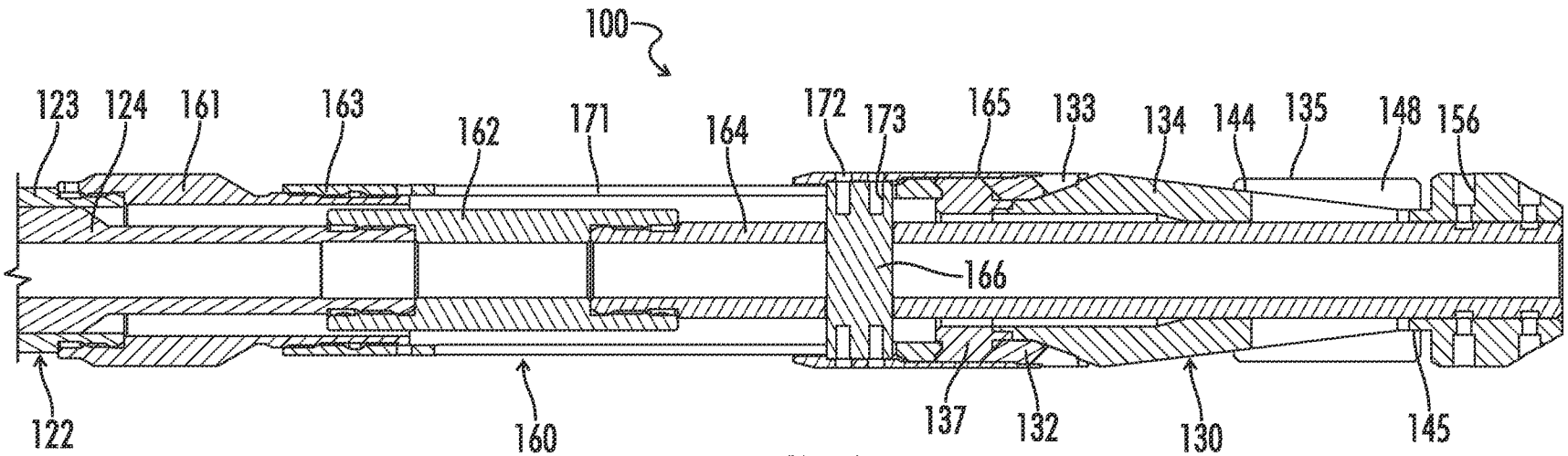
FIG. 15 is an axial, cross-sectional view of tool assembly 100 shown in FIG. 12, the view of FIG. 15 being rotated axially 90° relative to the elevational view of FIG. 14.
Figure 16:
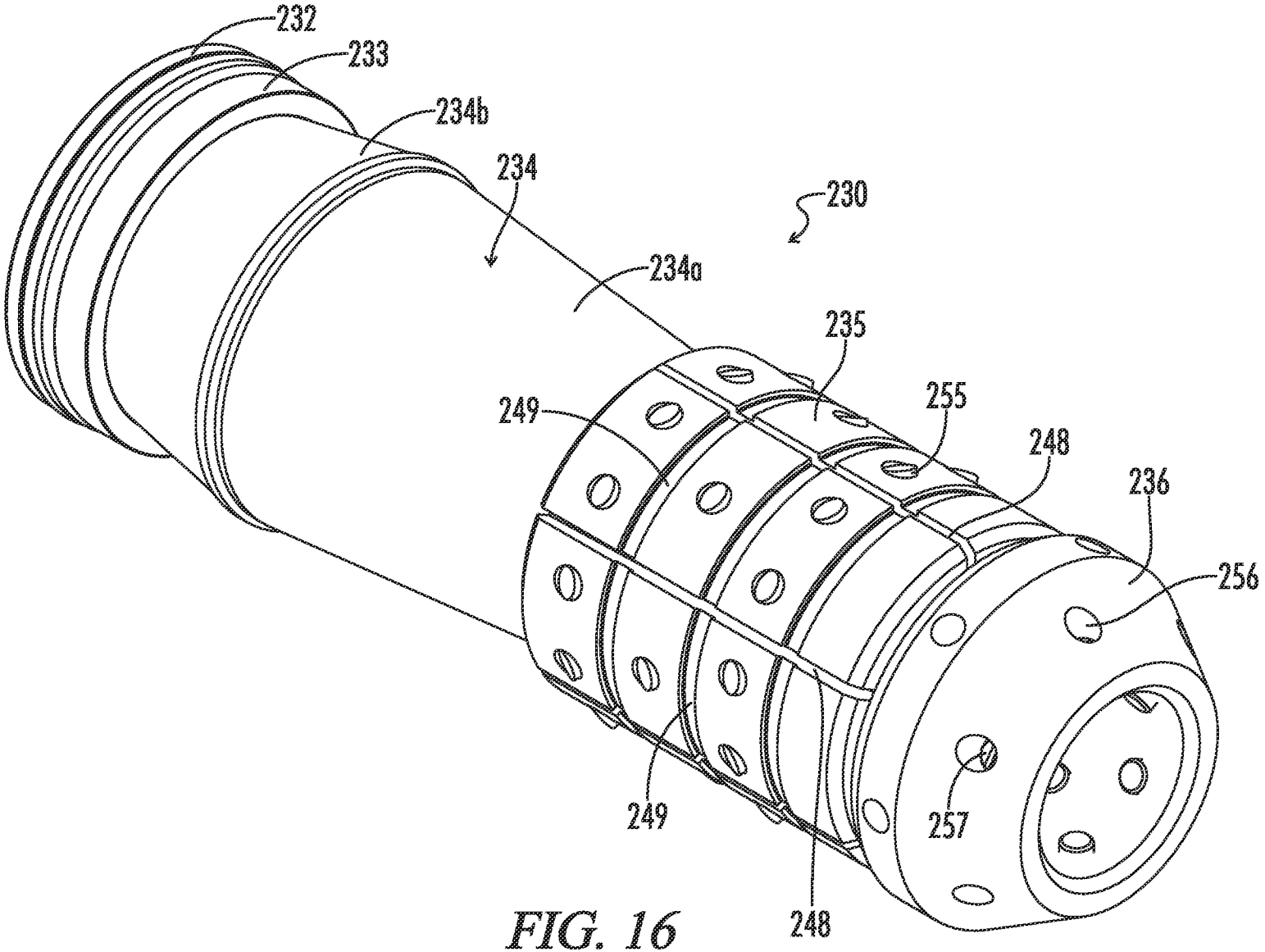
FIG. 16 is an isometric view, taken from an angle as in FIGS. 3 and 10, of a third preferred embodiment 230 of the novel frac plugs of the subject invention.
Figure 17:
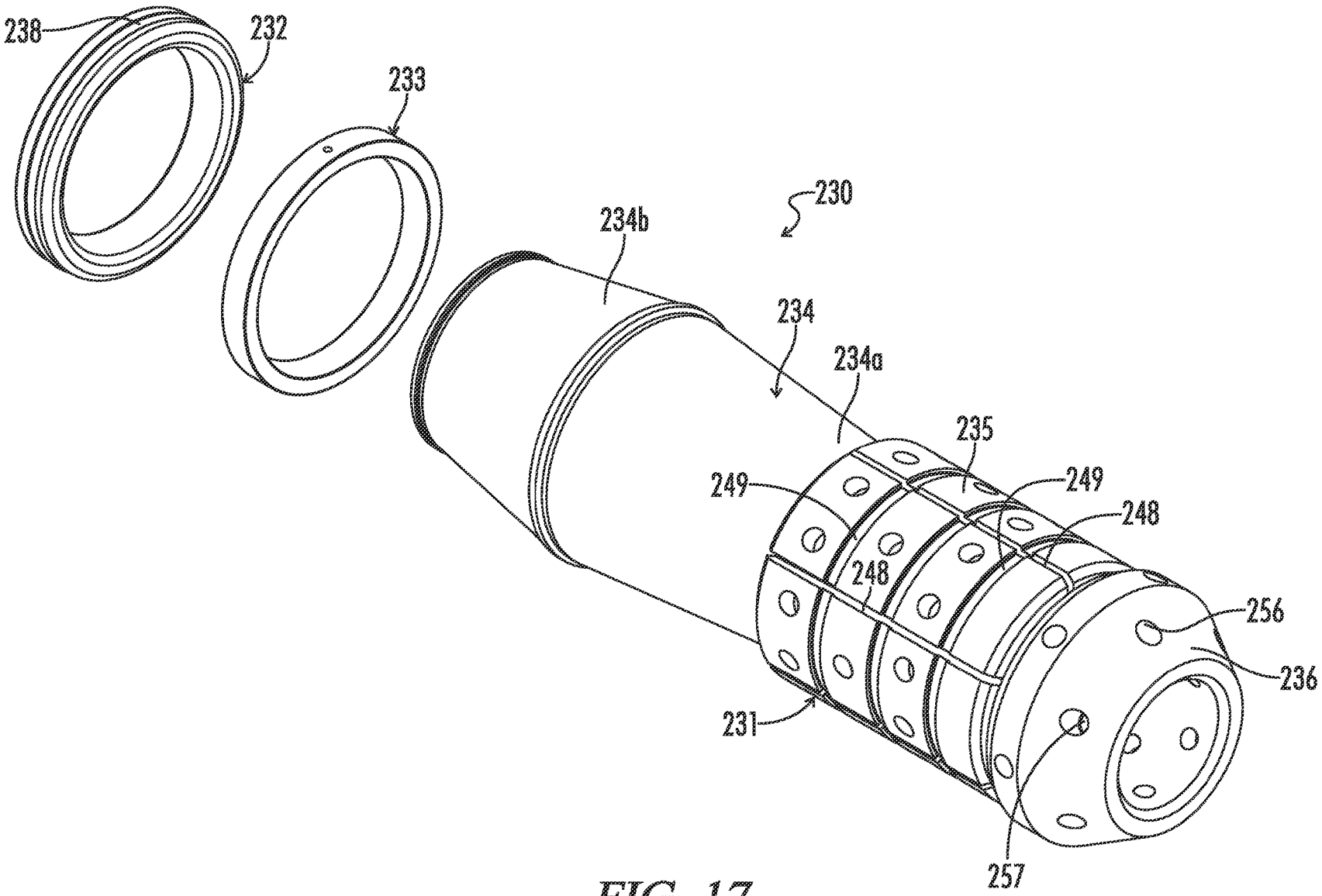
FIG. 17 is an exploded isometric view of frac plug 230 shown in FIG. 16, showing the components thereof in isometric views.
Figure 18:
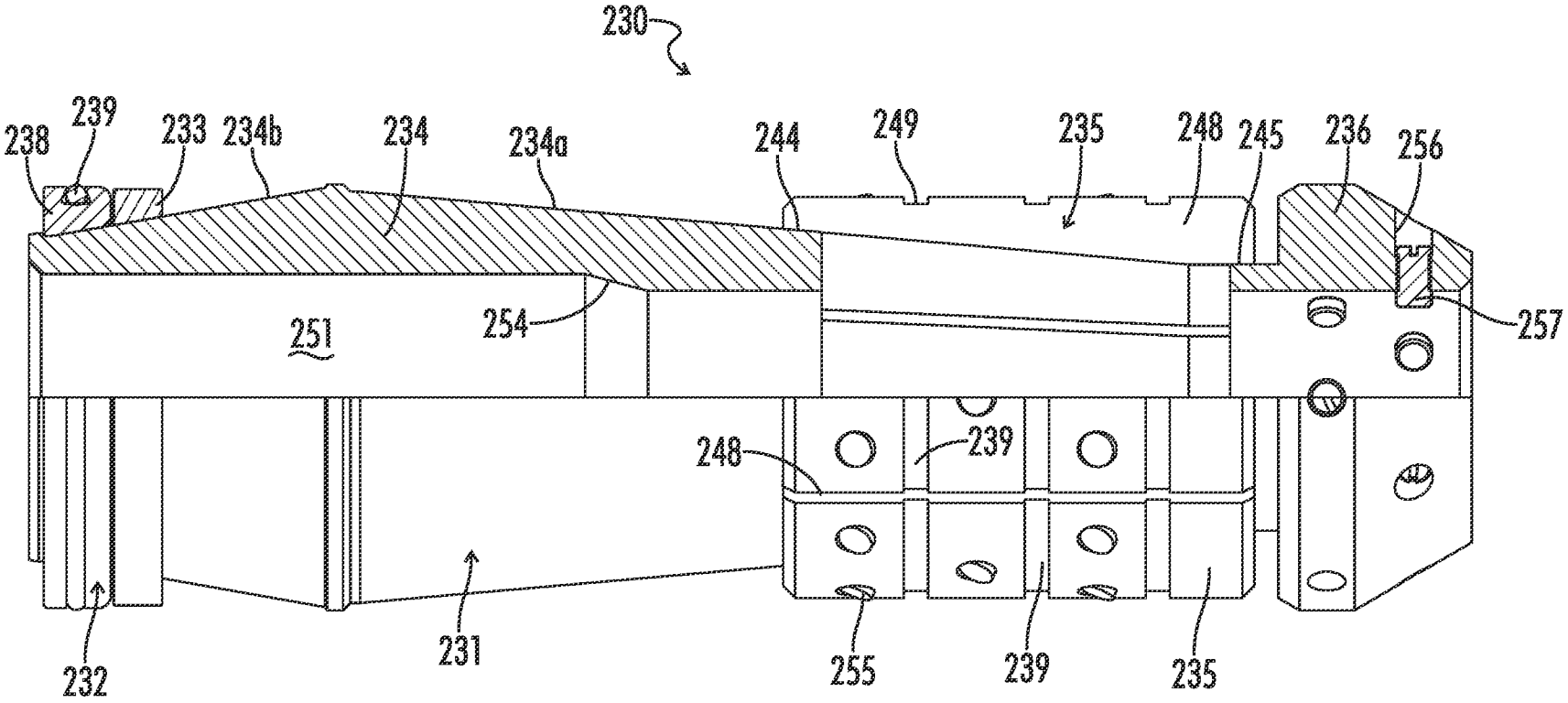
FIG. 18 is an axial, quarter-sectional view of frac plug 230 shown in FIGS. 16-17, the upper end of plug 230 being on the left and the lower end being on the right.

Adaptor 160, for example, generally comprises an outer connector 161, an inner connector 162, an outer push sleeve 163, an inner pull mandrel 164, a seal sheath 165, and a sheath connector 166 as shown in FIG. 15. Outer connector 161 has a profiled, generally cylindrical shape. Outer connector 161 is assembled at its upper end to push drive 123 on setting tool 122, for example, by a threaded connection. The lower end of outer connector 161 is assembled to outer push sleeve 163, for example, by a threaded connection.

Push sleeve 163 has a profiled, generally cylindrical shape. It is provided with a pair of slots 171. Slots 171 extend longitudinally through a substantial portion of push sleeve 163. They extend parallel to each other on opposite sides of push sleeve 163, i.e., they are separated radially by 180°. The lower end of push sleeve 163 engages the upper face of thrust ring 137 of plug 130.

Inner connector 162 has a profiled, generally cylindrical shape and is assembled at its upper end to pull drive 124 on setting tool 122, for example, by a threaded connection. The lower end of inner connector 162 is assembled to inner pull mandrel 164, for example, by a threaded connection. Pull mandrel 164 has a generally cylindrical shape. The lower end of pull mandrel 164 is releasably connected to setting ring element 136. For example, pull mandrel 164 may be releasably connected to setting ring element 136 by threaded shear screws, shear pins, or other shearable connectors (not shown) passed through radial holes 156 in setting ring element 136 and into bottomed holes in inner pull mandrel 164. The shearable connectors will allow frac plug 130 to separate from adaptor 160 and setting tool 122 once it is set.

Seal sheath 165 has a profiled, generally cylindrical shape. It is slidably received around the lower end of outer push sleeve 163 and extends downward a distance sufficient to extend around and cover cup seal 132. Thus positioned, it will protect cup seal 132 from damage as tool assembly 100 and plug 130 are run into liner 10. Seal sheath 165 is coupled at its upper end to inner pull mandrel 164 so that, as described further below, it may be withdrawn to allow setting of cup seal 132.

For example, seal sheath 165 is coupled to inner pull mandrel 164 by sheath connector 166. More specifically, sheath connector 166 extends between opposing inner surfaces of seal sheath 165, passing through slots 171 in outer push sleeve 163 and a passage in pull mandrel 164 defined by a pair of transversely aligned holes. Sheath connector 166 is connected to seal sheath 165, for example, by threaded connectors (not shown) passing through openings 172 in sheath 166 and into threaded bottomed holes 173 in sheath connector 166. Thus, as inner pull mandrel 164 is pulled upwards, seal sheath 165 will slide upwards over outer pull sleeve 263.

Preferably, tool assembly 100 will have shearable connectors (not shown) that releasably secure the push components of setting tool 122 and adaptor 160 (push drive 123, outer connector 161, and outer push sleeve 163) and the pull components (pull drive 124, inner connector 162, and inner pull mandrel 164), immobilizing them from moving relative to each other. As described herein, setting of plug 130 is accomplished by applying compressive force along the axis of plug 130. Thus, if the components are not immobilized, plug 130 may set partially or otherwise jam as it is run into liner 10.

Setting tool 122 will generate a downward force through push drive 123 that will be transmitted through adaptor outer connector 161 and outer push sleeve 163 and bear on thrust ring 137 of plug 130. The lower face of push sleeve 163 and upper face of thrust ring 137 have mating profiles to provide more secure engagement between the components. An upward force will be generated through setting tool pull drive 124 and transmitted through adaptor inner connector 162 and inner pull mandrel 164 to setting ring element 136 of plug 130.

Once a predetermined level of compressive force is generated by setting tool 122 any shearable connectors immobilizing the components of setting tool 122 and setting tool adaptor 160 will be sheared and shear forces will be generated throughout plug body 131. Once a predetermined level of shear force is reached, the connection between slip elements 135 and setting ring 136 provided by bridging portions 145 will break, allowing those elements 135/136 to separate. For example, bridging portions 145 may shear generally along an annular plane 145 aligned with the lower, inner cylindrical surface of slip elements 135 and the upper, outer cylindrical surface of setting ring 136.

At that point, inner pull mandrel 164 of adaptor 160 will begin to move upwards relative to outer push sleeve 163, pulling setting ring 136 along with it. The nipple at the upper end of setting ring 136 will shift axially upward into the lower end of slip elements 135. That shift allows the upward-facing shoulder formed by the enlarged diameter portion of setting ring 136 to butt against the lower surface of slip elements 135.

As increasing axial force is generated by setting tool 122, the connection between wedge element 134 and slip elements 135 provided by bridging portions 144 will break, allowing wedge 134 to be driven downward into the bore of slip elements 135. For example, bridging portions 144 may shear generally along an annular plane 144 aligned with the outer tapered surface of wedge 134 and the inner tapered surface of slip elements 135. As wedge 134 travels axially downward, the complementary conical surfaces on lower ramping surface **134*a* of wedge 134 and slips 135 allow the lower portion of wedge 134 to ride under slip elements 135**.

As wedge 134 continues downward, it generates radial load on slip elements 135. The connections between adjacent slip elements 135 provided by bridging portions 144 and 145 will break, allowing slip elements 135 to separate from each other. For example, slip elements 135 may separate along burst lines aligned with slits 148. Separated slips 135 eventually will move radially outward into contact with liner 10. Thus, jammed between the outer conical surface of wedge 134 and liner 10, slips 135 are able to anchor plug 130 within liner 10.

As inner pull mandrel 164 moves axially upward, it not only shifts setting ring 136 and slips 135 upward, but being coupled to sheath connector 166, it also carries with it seal sheath 165. Thus, by the time slips 135 engage liner 10, seal sheath 165 has slid upwards across outer pull sleeve 163 a sufficient distance to uncover segmented seal backup 133 and cup seal 132. Once the lower portion of wedge 134 has been fully driven into slips 135 and slips 135 have shifted radially outward into contact with liner 10, shear forces across thrust ring 137 will increase rapidly. When those forces exceed a predetermined limit, thrust ring 137 will shear along lines generally co-extensive with the outer radial limits of the abutment between thrust ring 137 and wedge 134 and the inner radial limits of the abutment between thrust ring 137 and outer push sleeve 163.

Once thrust ring 137 shears, its radial outer portion will be driven downward by outer push sleeve 163 of adaptor 160. Cup seal 132 and segmented seal backup 133 then will be driven across upper tapered surface 134*a* of wedge 134. Having been uncovered, as they move downward on upper tapered surface 134*a*, cup seal 132 and seal backup ring 133 will expand radially. Segmented seal backup ring 133 will break apart into individual backup segments 133*a* and will expand radially into contact with liner 10. Thrust ring 137 also will expand the upper lip of cup seal 132 radially outward into contact with liner 10.

As noted above, setting tool 122 and setting tool adaptor 160 are connected to plug 130 by shearable connectors extending between setting ring 136 and inner pull mandrel 164. When the lower portion of wedge 134 has been fully driven into slips 135, and cup seal 132 and seal backup segments 133*a* have ridden up the upper portion of wedge 134 and into sealing engagement with liner 10, the shear forces across the shearable connectors will increase further. When those forces exceed a predetermined limit, the connectors will shear, relieving any further compressive force on plug 130. Shearing of the connectors also releases setting tool adaptor 160 from setting ring 136. Setting tool 122 and setting tool adaptor 160 then can be pulled out of plug 130 and liner 10 via wireline 24.

Plug 130 then will be fully installed and will be ready to receive a frac ball (not shown). Once deployed, the frac ball will land on seat 154 in the bore of wedge 134. Preferably, seat 154 is located in wedge 134 such that, when plug 130 is installed and the lower portion of wedge 134 is fully inserted into slips 135, seat 154 will be positioned between the upper and lower ends of slips 135, and more preferably, well below the axial midpoint of slips 135. When fluid pressure is generated above the frac ball, therefore, it will create radial load on wedge 134 and slips 135. That radial load will further support the engagement between slips 135 and liner 10.

Increasing fluid pressure above the frac ball also will cause cup seal 132 to further expand radially outward, creating an increasingly more robust seal with liner 10. Backup segments 133, having been radially expanded outward into contact with liner 10, will impede downward extrusion of cup seal 132. Frac fluid will be unable to flow past frac plug 130 and will be diverted through perforations in liner 10 to create fractures 9.

It will be appreciated that novel plug 130 offers further advantages over prior art plugs. Plug 130 and other embodiments that have a unitary or integral plug body comprising a wedge element with an upper and lower ramping surface allow further control over the sequence and timing of anchoring and sealing plug 130. The compressive forces required to anchor the plug, that is to break the bridging portions between the wedge and slip elements and drive the slip elements up the lower ramping surface, and to seal the plug, that is, to initiate expansion of the seal by driving it up the upper ramping surface, may be separately controlled. The compressive force required for anchoring the plug may be set lower than that required to seal the plug, thus helping to ensure that the plug is both properly anchored and sealed.

Control over the sequence and timing of plug collapse and setting in conventional plugs typically is determined largely through the taper angles provided on the components, for example, the taper angles of the wedge and slips. In the novel plugs, such control also is provided by the design of the bridging portions and is not nearly as sensitive to variations in material properties from blank to blank. The integral plug body and the bridging portions incorporated therein will be made from the same blank. Thus, even if there is considerable variation from blank to blank, the relative strength of the bridging portions will be consistent from plug to plug. It is believed, therefore, that the novel plugs can be installed more reliably even when they are fabricated from softer materials, such as composites.

Frac Plug 230 and Setting Tool Adaptor 260

A third preferred embodiment 230 of the novel frac plugs is shown in greater detail in FIGS. 16-20. As seen best in the exploded view of FIG. 17, frac plug 230 generally comprises plug body 231, a seal ring 232, and a seal backup ring 233. Plug body 231 is substantially identical to plug body 131 of plug 130 described above. As in plug body 131, plug body 231 of plug 230 comprises a wedge element 234 having a lower ramping surface 234*a* and an upper ramping surface 234*b*, a plurality of slip elements 235, and setting ring element 236. Wedge element 234 is bridged to slip elements 235 by portions 244. Slip elements 235 are bridged to setting ring element 236 by portions 245. It will be noted, however, that slip elements 235 are provided with circumferential grooves 249 as well as slits 248. Grooves 249 help reduce the likelihood that relatively large pieces of slips 235 are left over after drilling plugs 230 out of liner 10 once the fracturing operation is completed.

Seal ring 232 and seal backup ring 233, as described further below, cooperate to provide a pressure seal between liner 10 and plug 230. Seal ring 232 is carried on upper ramping surface 234*b* of plug body 231. It has an annular ring body 238. The inner surface of ring body 238 is beveled to provide seal ring 232 with a downward facing tapered surface that is complimentary to the upward facing taper of upper ramping surface 234*b*. Lower face of seal ring body 238 bears on an upper face of seal backup ring 233. Seal backup ring 233 also is carried on upper ramping surface 234*b* of plug body 231. It also has a generally annular, ring shape. Its inner surface also is beveled to provide seal backup ring 233 with a downward facing tapered surface that is complimentary to the upward facing taper of upper ramping surface 234*b*.

When frac plug 230 is set, as described further below, radial expansion of seal backup dug 233 will cause it to split, allowing seal ring body 238 and seal backup ring 233 to travel downward over upper ramping surface 234*b* of wedge 234 and move radially outward. Accordingly, seal ring body 238 is fabricated from a sufficiently ductile material it to expand radially into contact with liner 10 without breaking. The outer circumference of seal ring body 238 preferably has an annular groove in which an elastomeric O-ring 239 is mounted. As seal ring 232 expands radially, seal ring body 238 and O-ring 239 seal against liner 10. Seal ring 232 is thus able to provide a seal between plug 230 and liner 10. If desired, an elastomeric band may be used instead of O-ring 239. Similarly, an elastomeric O-ring or other elastomeric material may be provided on the inner surface of seal ring body 238 to enhance the seal with wedge 234.

Plug 230 also may be deployed and installed in a well as described above in reference to plugs 30 and 130. Plug 230, for example, preferably will be installed by a second preferred embodiment 200 of the novel tool assemblies. Tool assembly 200 will be coupled to wireline, such as wireline 24 shown schematically in FIG. 2A. As may be seen in FIG. 20, tool assembly 200 also is coupled to plug 230 and generally comprises setting tool 122 and a second preferred embodiment 260 of the novel setting tool adaptors. Once plug 230 is deployed to the desired location in liner 10, setting tool 122 will be actuated to generate axial compressive forces that will be transmitted through adaptor 260 to plug 230. The compressive forces will be applied between seal ring 232 and setting ring element 236 to linearly compress plug 230 along its major axis.

Figure 20:
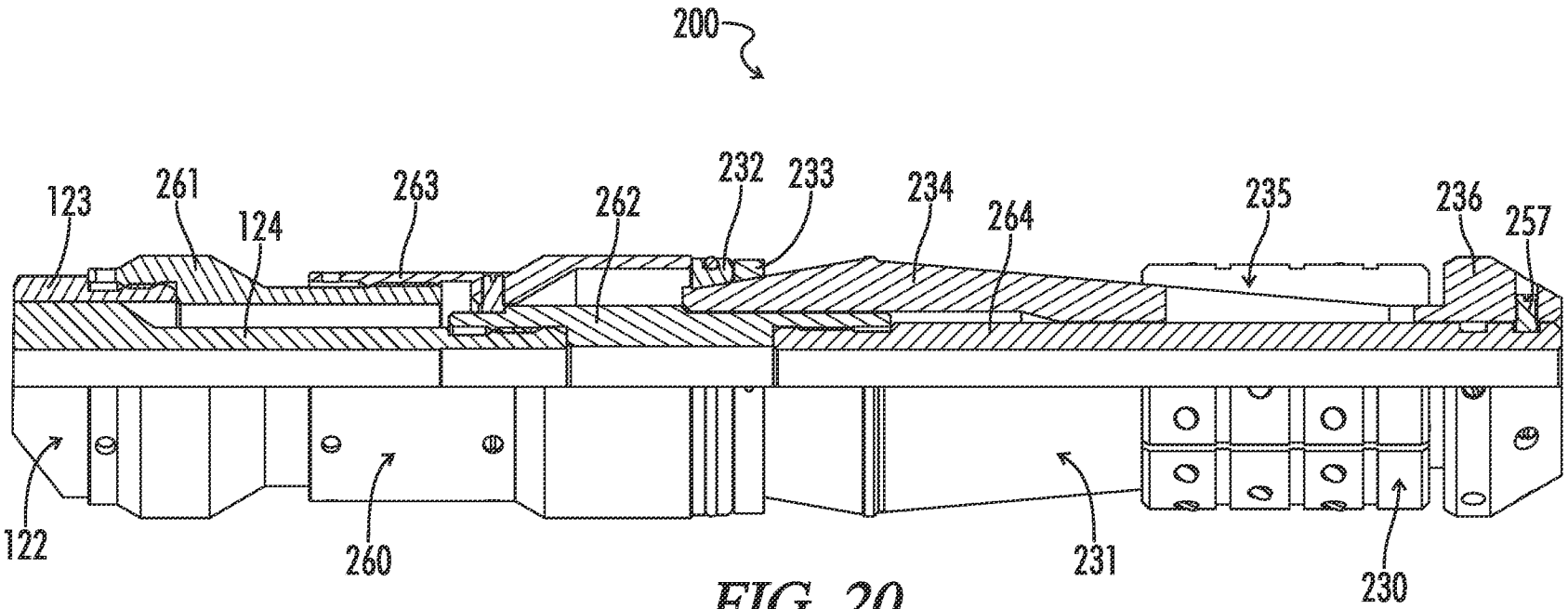
FIG. 20 is an axial, quarter-sectional view of a second preferred embodiment 200 of the novel tool assemblies of the subject invention, tool assembly 200 comprising novel frac plug 230 and a second preferred embodiment 260 of the novel setting tool adaptors of the subject invention.

As may be seen in FIG. 20, adaptor 260 generally comprises an outer connector 261, an inner connector 262, an outer push sleeve 263, and an inner pull mandrel 264. Outer connector 261 has a profiled, generally cylindrical shape. Outer connector 261 is assembled at its upper end to push drive 123 on setting tool 122, for example, by a threaded connection. The lower end of outer connector 261 is assembled to outer push sleeve 263, for example, by a threaded connection. Push sleeve 263 has a profiled, generally cylindrical shape. The lower end of push sleeve 263 engages the upper face of seal ring 232 of plug 230.

Inner connector 262 has a profiled, generally cylindrical shape and is assembled at its upper end to pull drive 124 on setting tool 122, for example, by a threaded connection. The lower end of inner connector 262 is assembled to inner pull mandrel 264, for example, by a threaded connection. Pull mandrel 264 has a generally cylindrical shape. The lower end of pull mandrel 264 is releasably connected to setting ring element 236. For example, pull mandrel 264 may be releasably connected to setting ring element 236 by threaded shear screws 257 passed through radial holes 256 in setting ring element 236 and into bottomed holes in inner pull mandrel 264. Other shearable or frangible connections, however, may be used.

Setting tool 122 will generate a downward force through push drive 123 that will be transmitted through adaptor outer connector 261 and outer push sleeve 263 and bear on seal ring 232 of plug 230. An upward force will be generated through setting tool pull drive 124 and transmitted through adaptor inner connector 262 and inner pull mandrel 264 to setting ring element 236 of plug 230.

Figure 19A:
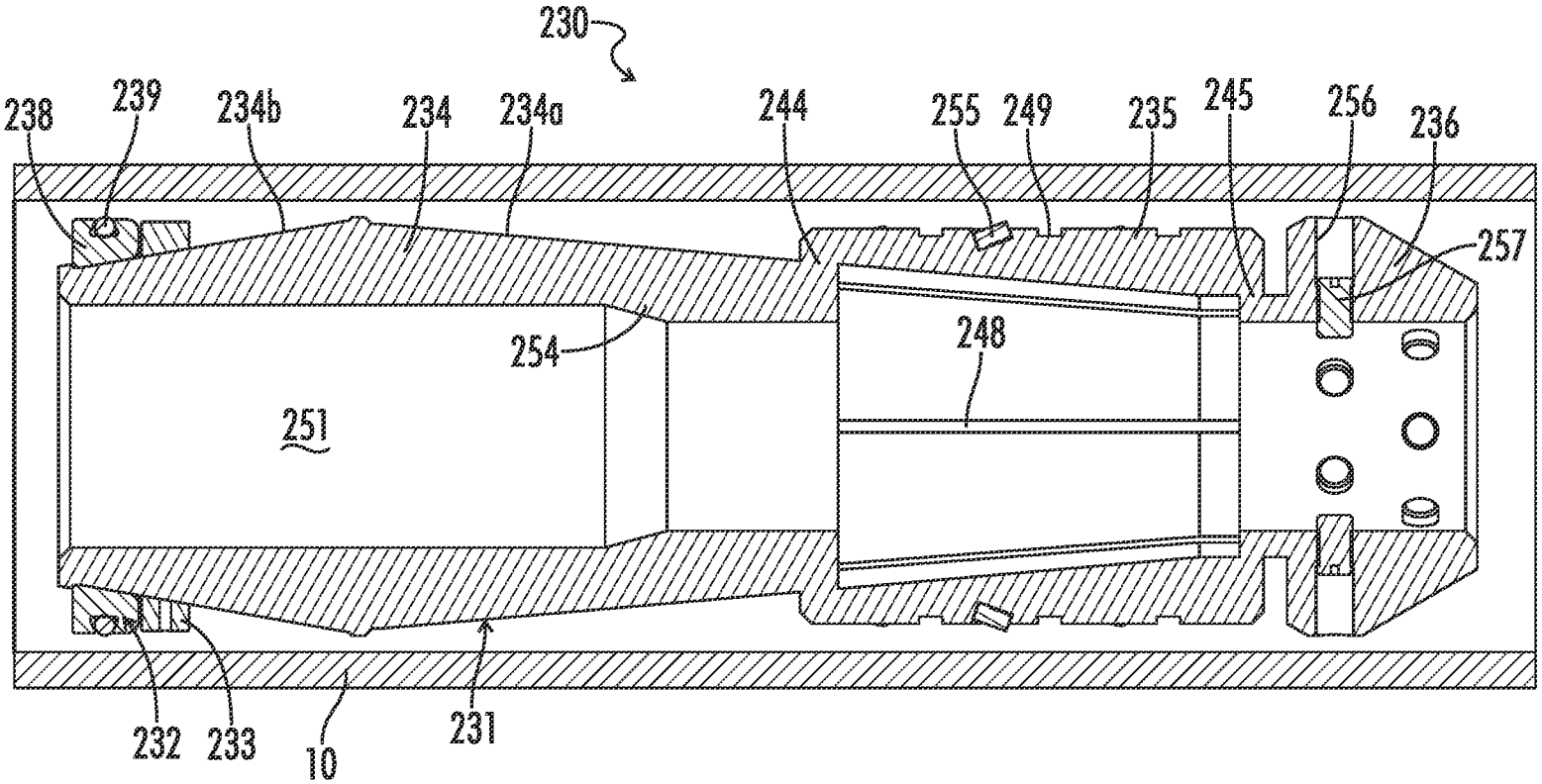
FIG. 19A is an axial, cross-sectional view of frac plug 230 shown in FIGS. 16-18, which view shows frac plug 230 in its unset state in liner 10.
Figure 19B:
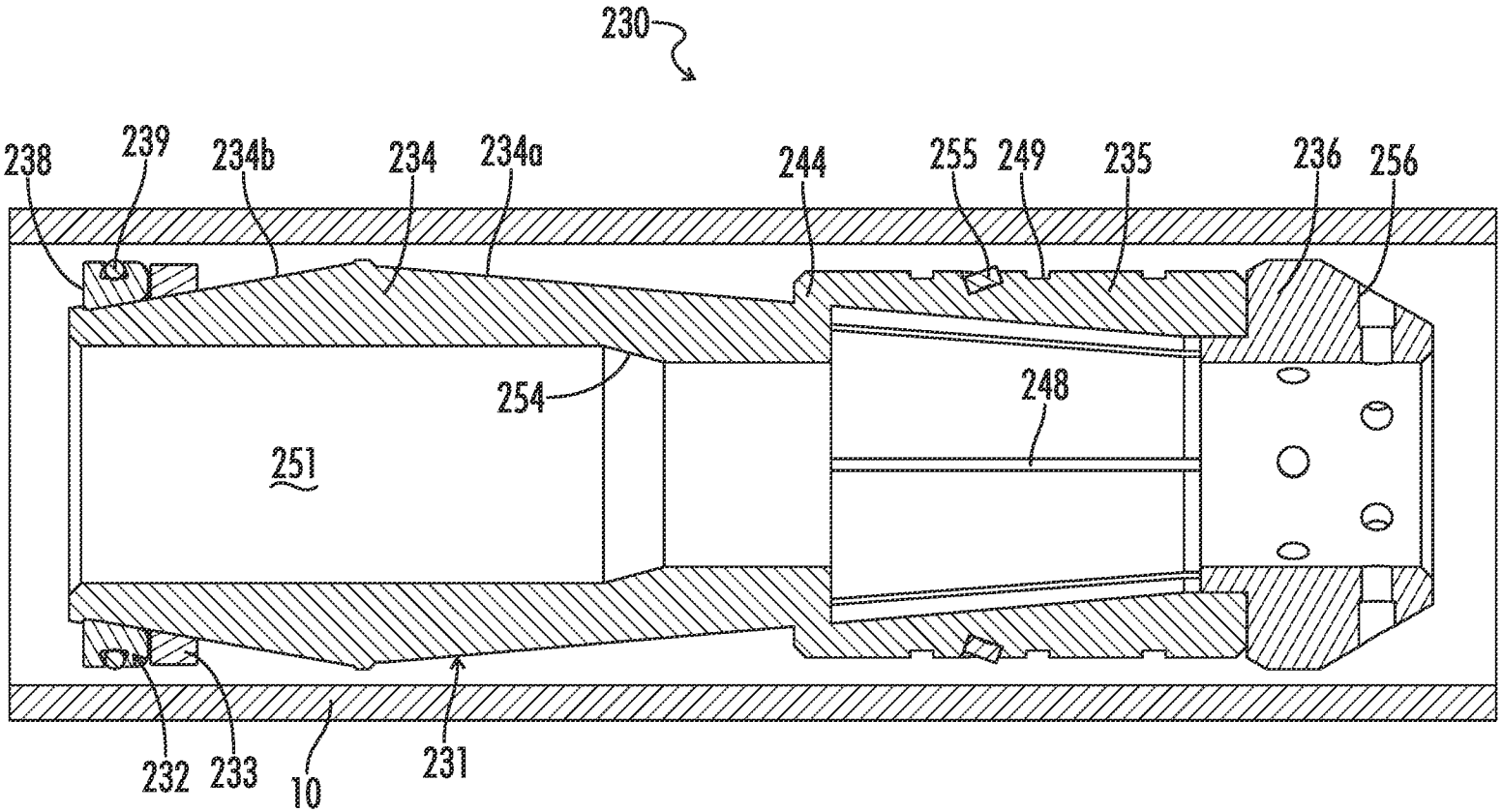
FIG. 19B is an axial, cross-sectional view of frac plug 230 in a partially set state.
Figure 19C:
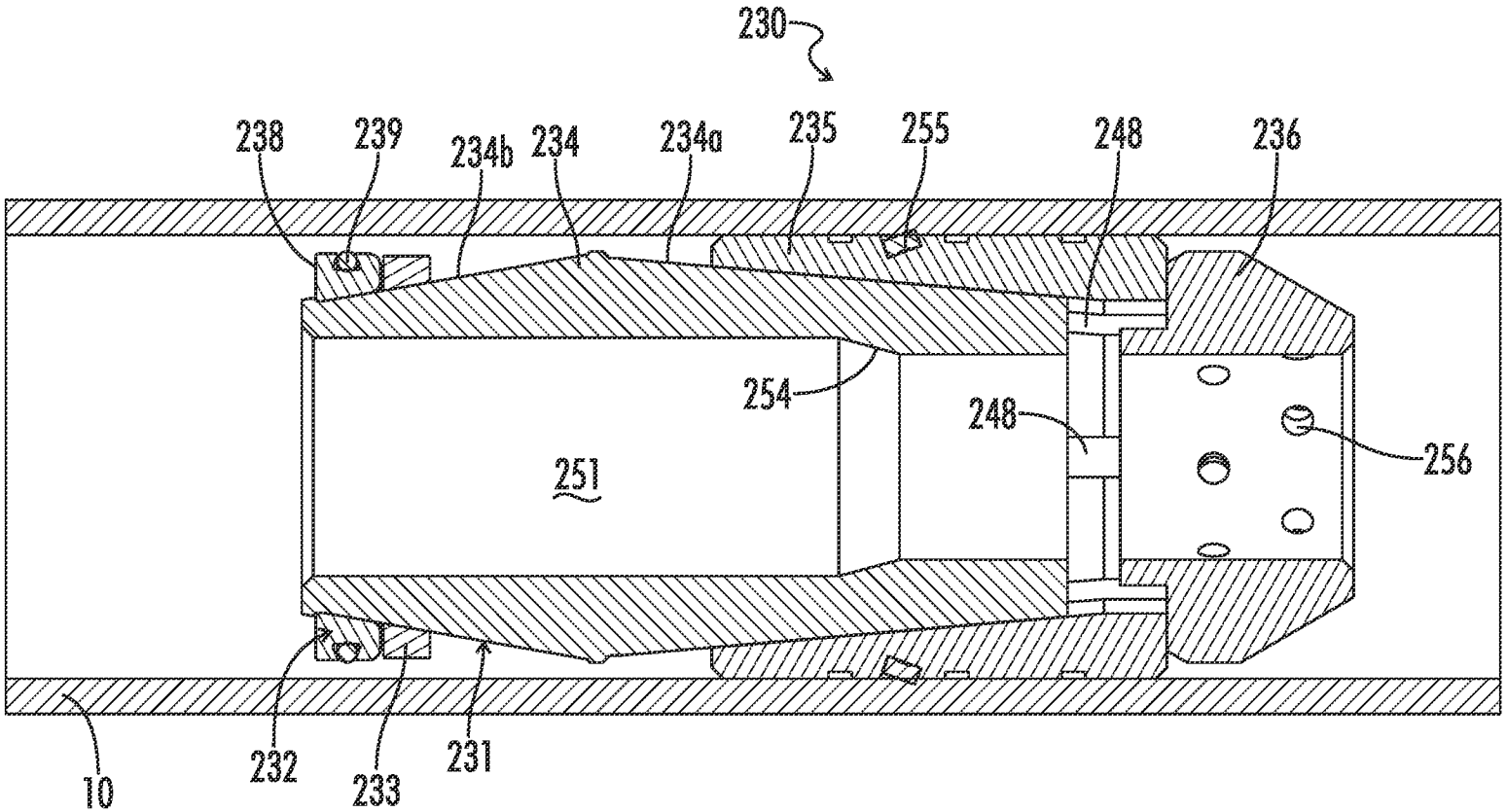
FIG. 19C is an axial, cross-sectional view of frac plug 230 is a more complete, but still partially set state where plug 230 is anchored, but not yet sealed.

Setting of plug 230 will be initiated generally as described above in reference to plug 130. Once shear forces across plug 230 reach a predetermined level, bridging portions 245 between slip elements 235 and setting ring 236 will break, allowing setting ring 236 to move upward and butt into the lower end of slip elements 235 as shown in FIG. 19B. As shear across plug 230 increases, bridging portions 244 between wedge element 234 and slip elements 235 will break, allowing wedge 234 to be driven downward into the bore of slip elements 235. As wedge 234 is driven downward it generates radial load on slip elements 235. Slip elements 235 will separate and move radially outward into contact with liner 10. Thus jammed between wedge 234 and liner 10, slips 235 are able to anchor plug 230 within liner 10 as shown in FIG. 19C.

Once wedge 234 has been fully driven into slips 235 and slips 235 have shifted radially outward into contact with liner 10, the axial load on seal ring 232 and seal backup ring 233 will increase rapidly. As that load increases to a predetermined limit, seal backup ring 233 will burst. Seal backup ring 233 preferably is provided with a radial hole 243. Radial hole 243 allows seal backup ring to burst along predetermined lines. Sizing of radial hole 243 also allows more precise control over the level of radial force required to burst seal backup ring 233.

Figure 19D:
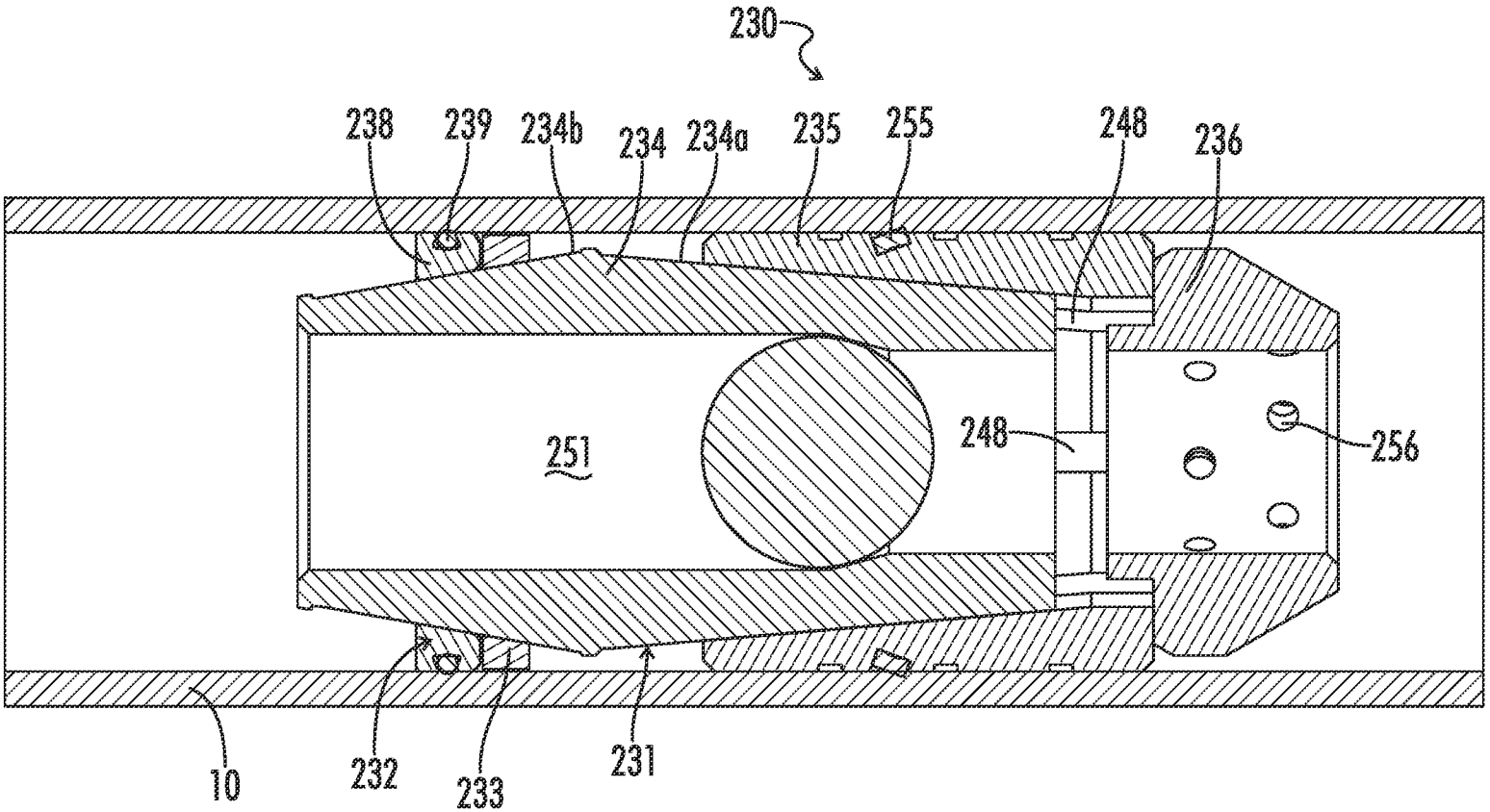
FIG. 19D is an axial, cross-sectional view of frac plug 230 in its fully set state where plug 230 is anchored and sealed.

Once seal backup ring 233 has burst, seal ring 232 and seal backup ring 233 will be driven downward and across upper tapered surface 234*b* by outer push sleeve 263 of adaptor 260. As they move downward on upper tapered surface 234*b*, seal ring 232 and seal backup ring 233 will expand radially into contact with liner 10 as shown in FIG. 19D. More specifically, ring body 238 of seal ring 232 has a nominal outer diameter when it is in its unset condition and positioned toward the upper end of upper ramping surface 134*b* as shown in FIGS. 19A-C. As it is pushed up upper ramping surface 134*b* to its set position in the mid-section of upper ramping surface 134*b* as shown in FIG. 19D, it has an enlarged outer diameter sufficient to bring it into sealing engagement with liner 10.

When wedge 234 has been fully driven into slips 235, and seal ring 232 and seal backup ring 233 have been set, the shear forces across shear screws 257 will increase. Shear screws 257 will shear releasing setting tool adaptor 260 from setting ring 236. Plug 230 then will be fully installed and will be ready to receive a frac ball. Once deployed, the frac ball will land on seat 254 in the bore of wedge 234 as shown in FIG. 191). As with seat 154 in plug body 131, seat 254 preferably is located in wedge 234 such that, when plug 230 is installed and wedge 234 is fully inserted into slips 235, seat 254 will be positioned between the upper and lower ends of slips 235, and more preferably, well below the axial midpoint of slips 235.

Setting Tool Adaptor 360

Plug 230 also may be deployed and installed in a well by a third preferred embodiment 300 of the novel tool assemblies. Tool assembly 300 will be coupled to wireline, such as wireline 24 shown schematically in FIG. 2A. As may be seen in FIGS. 21-22, tool assembly 300 also is coupled to plug 230 and generally comprises setting tool 122 and a third preferred embodiment 360 of the novel setting tool adaptors. Once plug 230 is deployed to the desired location in liner 10, setting tool 122 will be actuated to generate axial compressive forces that will be transmitted through adaptor 360 to plug 230. The compressive forces will be applied between seal ring 232 and setting ring element 236 to linearly compress plug 230 along its major axis.

Figure 21:
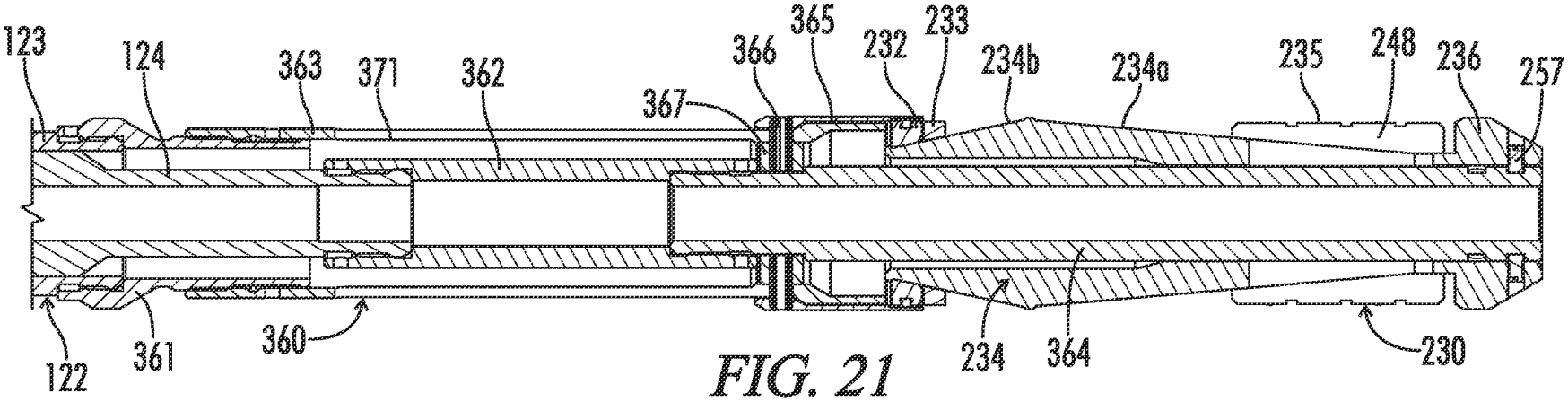
FIG. 21 is an axial, cross-sectional view of a third preferred embodiment 300 of the novel tool assemblies of the subject invention, tool assembly 300 comprising novel frac plug 230 and a third preferred embodiment 360 of the novel setting tool adaptors of the subject invention.
Figure 22:
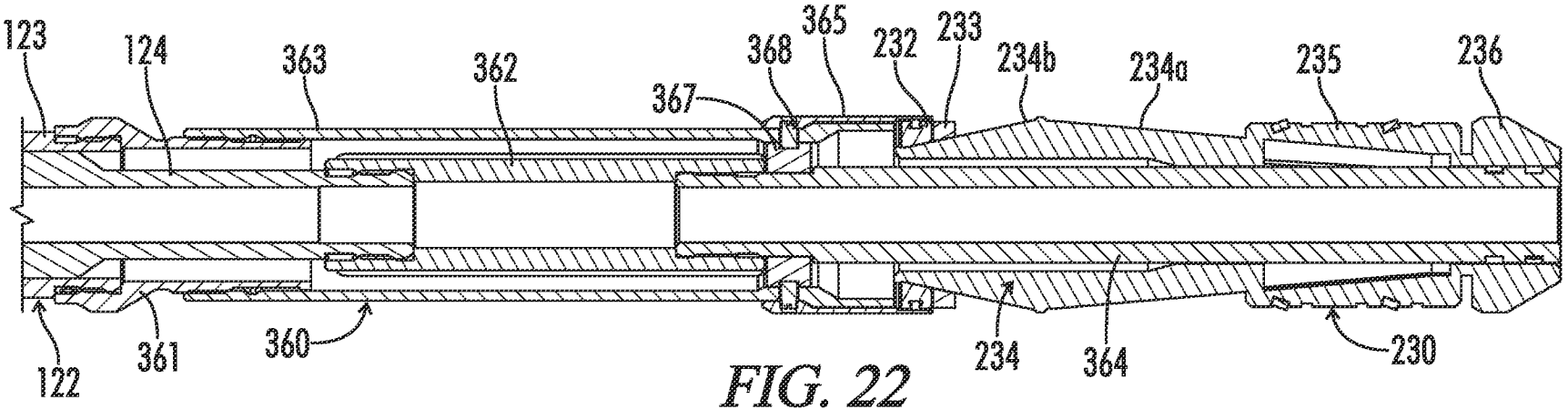
FIG. 22 is an axial, cross-sectional view of tool assembly 300 shown in FIG. 21, the view of FIG. 22 being rotated axially 45° from the view of FIG. 21.

As may be seen in FIGS. 21-22, adaptor 360 generally comprises an outer connector 361, an inner connector 362, an outer push sleeve 363, an inner pull mandrel 364, a seal sheath 365, and a sheath connector 366. Outer connector 361 has a profiled, generally cylindrical shape. Outer connector 361 is assembled at its upper end to push drive 123 on setting tool 122, for example, by a threaded connection. The lower end of outer connector 361 is assembled to outer push sleeve 363, for example, by a threaded connection.

Push sleeve 363 has a profiled, generally cylindrical shape. It is provided with four slots 371. Slots 371 extend longitudinally through a substantial portion of push sleeve 363. They extend parallel to each other and are separated radially by 90°. The lower end of push sleeve 363 engages the upper face of seal ring 232 of plug 230.

Inner connector 362 has a profiled, generally cylindrical shape and is assembled at its upper end to pull drive 124 on setting tool 122, for example, by a threaded connection. The lower end of inner connector 362 is assembled to inner pull mandrel 364, for example, by a threaded connection. Pull mandrel 364 has a generally cylindrical shape. The lower end of pull mandrel 364 is releasably connected to setting ring element 236. For example, pull mandrel 364 may be releasably connected to setting ring element 236 by threaded shear screws 257 passed through radial holes 256 in setting ring element 236 and into bottomed holes in inner pull mandrel 364. Other shearable or frangible connections, however, may be used. The shearable connectors will allow frac plug 230 to separate from adaptor 360 and setting tool 122 once it is set.

Seal sheath 365 has a profiled, generally cylindrical shape and is slidably received around the lower end of outer push sleeve 363. Seal sheath 365 also extends around and covers seal ring 232, but is coupled to inner pull mandrel 364 so that it can be slid upward to allow seal ring 232 to be expanded radially into contact with liner 10.

For example, as shown in FIG. 21, seal sheath 365 may be coupled to pull mandrel 364 by four sheath connectors 366. Each sheath connector 366 extends radially inward through an opening in seal sheath 365, through its respective slot 371 in outer push sleeve 263, and into a hole provided in a coupling ring 367. Coupling ring 365 is an annular body that is carried around a reduced outer diameter portion at the upper end of inner pull mandrel 364. Sheath connectors 366, for example, may be roll pins that will frictionally engage the openings in seal sheath 365 and coupling ring 367. Other connectors, however, such as threaded connectors or other types of pins may be used. Similarly, coupling ring 367 may be eliminated or fabricated integrally with inner pull mandrel 364 and connector holes may be provided in inner pull mandrel 364 if desired.

Preferably, setting tool adaptor 360 will have shearable connectors that releasably secure and immobilize its push components (outer connector 361 and outer push sleeve 363) and pull components (inner connector 362 and inner pull mandrel 364). For example, as shown in FIG. 22, adaptor 360 may be provided with shear screws 368 that are passed through holes in seal sheath 365, into threaded holes in outer push sleeve 363, and thence into holes in coupling ring 367. Shear screws 368 will help prevent premature setting or jamming of plug 230 as it is run into liner 10.

Plug 230 may be set with adaptor 360 generally as described above. Setting tool 122 will generate a downward force through push drive 123 that will be transmitted through adaptor outer connector 361 and outer push sleeve 363 and bear on seal ring 232 of plug 230. An upward force will be generated through setting tool pull drive 124 and transmitted through adaptor inner connector 362 and inner pull mandrel 364 to setting ring element 236 of plug 230. Once that force exceeds a predetermined level, shear screws 368 will shear, generating compressive forces along the axis of plug 230.

Plug 230 then will set by sequential breaking and shearing of bridging portions 244/245 and seal backup ring 233 as described above and shown in FIG. 19. Bridging portions 245 will break and setting ring 236 to move upward and butt into the lower end of slip elements 235. Bridging portions 244 will break and wedge 234 will be driven downward, separating slip elements 235 and shifting them radially outward into contact with liner 10. As inner pull mandrel 364 moves axially upward, it carries with it seal sheath 365. Thus, by the time slips 235 engage liner 10, seal sheath 365 has shifted upwards a sufficient distance to uncover seal ring 232.

Seal backup ring 233 then will burst, allowing seal ring 232 and seal backup ring 233 to be driven downward across upper tapered surface 234*b* of plug body 231. Seal ring 232 and seal backup ring 233 will expand radially into contact with liner 10. Shear screws 257 will shear releasing setting tool adaptor 260 from setting ring 236.

It will be appreciated that novel adaptors 160 and 360 and similar embodiments provide important advantages over conventional setting tools. As discussed herein, the seals of frac plugs typically are fabricated from softer materials, such as elastomers and plastics. While gauge surfaces and the like provide some protection, the seals nevertheless can be easily be damaged as the plug is run into a liner. Such damage may mean that an effective pressure seal cannot be established when the plug is installed. By providing the novel setting tool assemblies with a retractable seal sheath, the seals may be protected until the plug is at proper depth in the liner, thus helping to ensure that a robust seal is formed when the plug is installed.

It also will be appreciated that certain functions and operations of the novel adaptors have been exemplified as being performed by subassemblies of separate parts. Separate parts often facilitate fabrication and assembly of the adaptors. At the same time, however, they may be assembled from fewer components. For example, adaptors 160/260/360 all comprise outer connectors 161/261/361 and outer push sleeves 163/263/363. Those separate components, however, may be fabricated as a single, unitary push member. The same is true of inner connectors 162/262/362 and inner pull mandrels 164/264/364. They may be fabricated as a single, unitary pull member.

Moreover, and as discussed above, economics of scale in the industry generally dictate that commercially available setting tools will be used in combination with an adaptor. The setting tool generates the compressive force required for installation of the novel plugs, while the adaptor transmits the compressive force to the plug. The setting tool typically has standard connections, while the adaptor is specifically configured for a particular plug or other downhole tool, in much the same way that a set of different sized sockets are used with a ratchet wrench. If desired, however, the novel setting tools can include force generating mechanisms as are commonly used in conventional, standardized setting tools. In other words, the setting tool and adaptor may be combined into a single tool, although as noted that generally will not be cost effective.

Plug bodies 31, 131, and 231 may be fabricated from materials typically used in plugs of this type. Such materials may be relatively hard metals, but typically would be relatively soft, or more brittle, more easily drilled metals, such as cast iron. More preferably, plug bodies 31/131/231 may be fabricated from non-metallic materials commonly used in plugs, such as fiberglass and carbon fiber resinous composite materials. When composites are used, plug bodies 31/131/231 may be molded, but more typically will be machined from wound fiber resin blanks, such as a wound fiberglass cylinder. Wound fiber resin blanks can be machined readily to provide the various elements and Such materials will allow the plug to be drilled more easily once fracturing is completed.

Plug bodies 31/131/231 also may be made from dissolvable metals, that is, metals that will dissolve, soften, disintegrate, or otherwise break down wholly or partially in the presence of existing or controlled conditions in the well by any mechanism. Such dissolvable metals typically are magnesium or aluminum alloys that may be dissolved, for example, with a plug of an acid solution. Other dissolvable metals include metal matrices, such as magnesium-graphite and magnesium-calcium matrices. The dissolvable metal may also be coated with materials that provide complimentary properties. Coatings may be used, for example, to protect the base metal prior to deployment of the plug, to strengthen it, or to control its rate of dissolution.

As readily appreciated by workers in the art, refinements in the basic design of the plug body will be dictated by the choice of materials. Metal being generally stronger, for example, the plug body may be made somewhat thinner and shorter when it is fabricated from metal instead of composites. In general, the taper angles for the wedge elements will provide a self-locking taper fit between the wedge and slips. The taper angle of the wedge element and slip elements thus may be less acute in metal plug bodies, for example, from about 10° to about 30°.

The choice of material also will determine in large part the geometry and other design criteria of the bridging portions joining the elements within the plug body. A cylindrical blank of wound fiber resin composites, for example, has much greater hoop strength than shear strength. Is essence, the windings create shear planes extending axially through the cylinder, while tending to absorb outward radial force. In contrast, the crystalline structure of most metals is sufficiently complex that the material strength is relatively constant regardless of the direction force is applied.

Thus, the manner, stress points, and nature of the break in the bridging portions will vary somewhat. Depending on the material used and the direction of the break, the break may be a relatively clean, distinct severing of the elements. In other instances, the break may be more of a rough tear. The object is simply that the bridging portions break sufficiently to allow independent movement of the once joined elements. That may be accomplished by scoring, thinning, perforating the material or in other conventional ways. Likewise, while the bridging portions in plug bodies 31/131/231 have been described as being broken by the application of axial or radial force, bridging portions may be broken by other mechanisms. For example, when the plug body is made from dissolvable metals, disintegration of the bridging portions may contribute to or create the "break" and allow separation of the joined elements.

Cup seals 32/132 may be made from elastomeric materials typically used for sealing elements in plugs of this type, such as nitrile butadiene rubber (NBR) and hydrogenated nitrile butadiene rubber (HNBR). Preferably, cup seals 32/132 may be made of a dissolvable elastomer, that is, an elastomer that will dissolve, soften, disintegrate, or otherwise break down wholly or partially in the presence of existing or controlled conditions in the well by any mechanism. The elastomer may be degraded, for example, by chemical or biological action. Dissolvable elastomers made for formed, for example, by elastomeric polymers carried in a dissolvable resin matrix. Similarly, the frac balls deployed onto the novel plugs may be made from dissolvable materials.

As noted, seal ring 232 of plug 230 preferably is fabricated from a sufficiently ductile material so as to allow the ring to deform plastically and expand radially into contact with a liner without breaking. For example, seal ring 232 may be fabricated from aluminum, bronze, brass, brass, copper, mild steel, or magnesium and magnesium alloys. Alternately, the ring body may be made of hard, elastomeric rubbers, such as butyl rubber.

Preferably, however, the seal ring is fabricated from a plastic material. Plastic components are more easily drilled, and the resulting debris more easily circulated out of a well. Engineering plastics, that is, plastics having better thermal and mechanical properties than more commonly used plastics, are preferred. Engineering plastics that may be suitable for use include polycarbonates and Nylon 6, Nylon 66, and other polyamides, including fiber reinforced polyamides such as Reny polyamide. "Super" engineering plastics, such as polyether ether ketone (PEEK) and polyetherimides such as Ultem®, are especially preferred. Mixtures and copolymers of such plastics also may be suitable. Preferred materials generally will have useful operating temperatures of at least 250° F., and preferably at least 350° F., and a tensile strength of a least 5,000 psi, preferably at least about 1,500 psi. Such preferred materials also generally will provide the ring body with an elongation factor of at least 10%, and preferably at least 30%.

As noted above, the seal ring may be provided with elastomeric O-ring, bands, or other elastomeric material around its outer or inner surface. Such elastomeric materials include those commonly employed in downhole tools, such as butyl rubbers, hydrogenated nitrile butadiene rubber (HNBR) and other nitrile rubbers, and fluoropolymer elastomers such as Viton.

As should be apparent from the foregoing discussion, references to "upper," "lower," "upward," "downward," and the like in describing the relative location or orientation of plug features are made contemplating an installed plug. Thus, an "upper" and "lower," and variants thereof, would be synonymous with, respectively, "uphole" and "downhole."

Plugs 30/130/230 and other embodiments also have been described as installed in a liner and, more specifically, a production liner used to fracture a well in various zones along the wellbore. A "liner," however, can have a fairly specific meaning within the industry, as do "casing" and "tubing." In its narrow sense, a "casing" is generally considered to be a relatively large tubular conduit, usually greater than 4.5" in diameter, that extends into a well from the surface. A "liner" is generally considered to be a relatively large tubular conduit that does not extend from the surface of the well, and instead is supported within an existing casing or another liner. In essence, a "liner" is a "casing" that does not extend from the surface. "Tubing" refers to a smaller tubular conduit, usually less than 4.5" in diameter. The novel plugs, however, are not limited in their application to liners as that term may be understood in its narrow sense. They may be used to advantage in liners, casings, and perhaps even in smaller conduits or "tubulars" as are commonly employed in oil and gas wells. A reference to liners shall be understood in context as a reference to all such tubulars.

Likewise, while the exemplified plugs are particularly useful in fracturing a formation and have been exemplified in that context, they may be used advantageously in other processes for stimulating production from a well. For example, an aqueous acid such as hydrochloric acid may be injected into a formation to clean up the formation and ultimately increase the flow of hydrocarbons into a well. In other cases, "stimulation" wells may be drilled in the vicinity of a "production" well. Water or other fluids then would be injected into the formation through the stimulation wells to drive hydrocarbons toward the production well. The novel plugs may be used in all such stimulation processes where it may be desirable to create and control fluid flow in defined zones through a well bore. Though fracturing a well bore is a common and important stimulation process, the novel plugs are not limited thereto.

It also will be appreciated that the description references frac balls. Spherical balls are preferred, as they generally will be transported though tubulars and into engagement with downhole components with greater reliability. Other conventional plugs, darts, and the like which do not have a spherical shape, however, also may be used to occlude the wedge bore in the novel plugs. The configuration of the "ball" seats necessarily would be coordinated with the geometry of such devices. "Balls" as used herein, therefore, will be understood to include any of the various conventional closure devices that are commonly pumped down a well to occlude plugs, even if such devices are not spherical. "Ball" seat is used in a similar manner. Moreover, as used herein in reference to the novel plugs, the term "bore" is only used to indicate that a passage exists and does not imply that the passage necessarily was formed by a boring process.

While this invention has been disclosed and discussed primarily in terms of specific embodiments thereof, it is not intended to be limited thereto. Other modifications and embodiments will be apparent to the worker in the art.

What is claimed is:

1. A frac plug apparatus, said plug comprising a plug body, wherein said plug body comprises:

(a) a central bore extending axially through said plug body; and (b) separable elements joined by relatively weak bridging portions adapted to break in a controlled manner, said separable elements thereby forming an integral component comprised of said separable elements, wherein said separable elements comprise:

i) a wedge element; and ii) an array of slip elements joined to said wedge element by first bridging portions; and iii) a ball seat in a portion of said central bore extending through said wedge element, said ball seat being situated in a midsection of said wedge element such that when said plug is set, said ball seat is situated radially inward of said slip elements.

2. The frac plug apparatus of claim 1, wherein said plug is set by applying along a major axis of said plug body a first compressive force across said first bridging portions, said first compressive force being effective to break said first bridging portions and shift said slip elements and said wedge into overlapping engagement such that said slip elements are displaced radially.

3. The frac plug apparatus of claim 2, wherein:

(a) said separable elements comprise a setting ring element joined to said slip elements by second bridging portions; and (b) wherein said plug may be set by applying along said major axis of said plug body a second compressive force across said second bridging portions, said second compressive force being effective to break said second bridging portions and shift said slip elements and said setting ring element into abutment.

4. The frac plug apparatus of claim 3, wherein said first compressive force is greater than said second compressive force whereby said second bridging portions break before said first bridging portions break.

5. The frac plug apparatus of claim 1, wherein said slip elements are configured generally as lateral segments of an open cylinder, said slip elements being separated by longitudinal slits extending through said plug body.

6. The frac plug apparatus of claim 5, wherein said slits comprise a first set of slits originating at the upper end of said slip elements and terminating proximate the lower end of said slip elements and a second set of slits originating at the lower end of said slip elements and terminating proximate the upper end of said slip elements.

7. The frac plug apparatus of claim 1, wherein said wedge element comprises:

(a) an outer surface that tapers radially inward in a downhole direction to provide an inverted truncated conical lower ramping surface; and (b) an outer surface that tapers radially inward in an uphole direction to provide a truncated conical upper ramping surface.

8. The frac plug apparatus of claim 1, wherein said plug body is fabricated from a wound-fiber resin blank.

9. The frac plug apparatus of claim 1, wherein said plug body is fabricated from a dissolvable metal.

10. The frac plug apparatus of claim 1, wherein:

(a) said wedge element has i) an outer surface that tapers radially inward in a downhole direction to provide an inverted truncated conical lower ramping surface; and ii) an outer surface that tapers radially inward in an uphole direction to provide a truncated conical upper ramping surface;

(b) said slip elements have a tapered inner surface complimentary to said wedge lower ramping surface;

(c) said first bridging portions joining said wedge element and said slip elements are situated at the lower end of said wedge element and the upper end of said slip elements; and (d) said plug comprises a radially expandable seal ring carried on said upper ramping surface; and (e) said seal ring comprises an annular ring body having a tapered inner surface complimentary to said wedge upper ramping surface.

11. An oil and gas well comprising a liner, wherein the frac plug apparatus of claim 1 has been installed by driving said wedge element into said slip elements.

12. The frac plug apparatus of claim 1, wherein said ball seat, when said plug is set, is situated below the axial midpoint of said slip elements.

13. The frac plug apparatus of claim 1, wherein:

(a) said wedge element has a tapered outer surface and said slip elements have a complimentarily tapered inner surface;

(b) said first bridging portions joining said wedge element and said slip elements are situated at the lower end of said wedge element and the upper end of said slip elements; and (c) said first bridging portions shear generally along an annular plane aligned with said tapered surfaces of said wedge element and said slip elements.

14. The frac plug apparatus of claim 13, wherein said tapered outer surface of said wedge and said tapered inner surface of said slip are provided with a taper from about 1° to about 10° off center.

15. The frac plug apparatus of claim 13, wherein said tapered outer surface of said wedge and said tapered inner surface of said slip provide a self-locking taper fit between said wedge element and said slip element.

16. The frac plug apparatus of claim 1, wherein said plug comprises a cup seal coupled to said plug body above said wedge element.

17. The frac plug apparatus of claim 16, wherein:

(a) said separable elements comprise an array of seal backup elements, said backup elements overlaying a lower portion of said cup seal and being joined to said wedge element by third bridging portions; and (b) said seal backup elements may be set by applying hydraulic pressure to said cup seal, said hydraulic pressure being effective to expand said cup seal radially and break said third bridging portions to allow said seal backup elements to separate and shift radially outward.

18. The frac plug apparatus of claim 17, wherein said backup elements are configured generally as lateral segments of an open cylinder, said backup elements being separated by longitudinal slits extending through said plug body, said slits originating at the upper end of said plug body and terminating proximate to said wedge element.

19. The frac plug apparatus of claim 1, wherein:

(a) said wedge element has i) an outer surface that tapers radially inward in a downhole direction to provide an inverted truncated conical lower ramping surface; and ii) an outer surface that tapers radially inward in an uphole direction to provide a truncated conical upper ramping surface;

(b) said slip elements have a tapered inner surface complimentary to said wedge lower ramping surface;

(c) said first bridging portions joining said wedge element and said slip elements are situated at the lower end of said wedge element and the upper end of said slip elements;

(d) said plug comprises a cup seal carried on said upper ramping surface; and (e) said cup seal has a tapered inner surface complimentary to said upper ramping surface.

20. The frac plug apparatus of claim 19, wherein:

(a) said plug comprises a thrust ring abutting the upper end of said plug body and the upper face of said cup seal; and (b) said cup seal may be set by applying along a major axis of said plug a third compressive force between said wedge element and said thrust ring, said third compressive force being effective to shear said thrust ring and shift said cup seal up said upper ramping surface and radially outward.

21. The frac plug apparatus of claim 20, wherein said plug comprises a seal backup ring carried on said upper ramping surface below said cup seal, said seal backup ring having a tapered inner surface complimentary to said upper ramping surface.

22. The frac plug apparatus of claim 21, wherein:

(a) said seal backup ring comprises an array of seal backup elements joined to each other by ring bridging portions; and (b) said seal backup elements may be set by applying said third compressive force to break said ring bridging portions and allow said seal backup elements to separate and to shift said seal backup elements up said upper ramping surface and radially outward.

23. A frac plug apparatus, said plug comprising a plug body, wherein said plug body comprises:

(a) a central bore extending axially through said plug body;

(b) separable elements joined by relatively weak bridging portions adapted to break in a controlled manner, said separable elements thereby forming an integral component comprised of said separable elements, wherein said separable elements comprise:

i) a wedge element; and ii) an array of slip elements joined to said wedge element by first bridging portions; and (c) a radially expandable seal ring;

(d) wherein said wedge element has:

i) an outer surface that tapers radially inward in a downhole direction to provide an inverted truncated conical lower ramping surface; and ii) an outer surface that tapers radially inward in an uphole direction to provide a truncated conical upper ramping surface;

(e) wherein said slip elements have a tapered inner surface complimentary to said wedge lower ramping surface;

(f) wherein said first bridging portions joining said wedge element and said slip elements are situated at the lower end of said wedge element and the upper end of said slip elements; and (g) wherein said seal ring is carried on said upper ramping surface and comprises an annular ring body having a tapered inner surface complimentary to said wedge upper ramping surface.

24. The frac plug apparatus of claim 23, wherein:

(a) said ring body of said seal ring is fabricated from a sufficiently ductile material such that said ring body can expand radially without breaking from an unset condition, in which said seal ring has a nominal outer diameter, to a set condition, in which said seal ring has an enlarged outer diameter; and (b) said plug may be set by applying along a major axis of said plug a third compressive force between said wedge element and said seal ring, said third compressive force being effective to shift said seal ring up said upper ramping surface from an unset position to a set position and to expand said seal ring radially outward from said unset condition to said set condition.

25. The frac plug apparatus of claim 23, wherein said seal ring is fabricated from a plastically deformable plastic.

26. The frac plug apparatus of claim 23, wherein said seal ring comprises an outer elastomeric seal received in a groove provided in the outer surface of said ring body.

27. The frac plug apparatus of claim 23, wherein said plug comprises a seal backup ring carried on said upper ramping surface of said wedge element below said seal ring and adapted to burst when said third compressive force is applied.

28. The frac plug apparatus of claim 23, wherein said seal backup ring is fabricated from plastic.

29. The frac plug apparatus of claim 23, wherein said seal ring is fabricated from plastically deformable plastics selected from the group consisting of polycarbonates, polyamides, polyether ether ketones, and polyetherimides and copolymers and mixtures thereof.

30. The frac plug apparatus of claim 23, wherein said annular ring body is fabricated from a plastically deformable plastic and has an elongation factor of at least about 10%.

31. A frac plug apparatus, said plug comprising a plug body, wherein said plug body comprises:

(a) a central bore extending axially through said plug body; and (b) separable elements joined by relatively weak bridging portions adapted to break in a controlled manner, said separable elements thereby forming an integral component comprised of said separable elements, wherein said separable elements comprise:

i) a wedge element;

ii) an array of slip elements joined to said wedge element by first bridging portions; and iii) a setting ring element joined to said slip elements by second bridging portions; and (c) wherein said plug is set by applying along a major axis of said plug body:

i) a first compressive force across said first bridging portions, said first compressive force being effective to break said first bridging portions and shift said slip elements and said wedge into overlapping engagement such that said slip elements are displaced radially; and ii) a second compressive force across said second bridging portions, said second compressive force being effective to break said second bridging portions and shift said slip elements and said setting ring element into abutment;

iii) wherein said first compressive force is greater than said second compressive force whereby said second bridging portions break before said first bridging portions break.

32. The frac plug apparatus of claim 31, wherein:

(a) said slip elements have a cylindrical inner surface and said setting ring element has a complimentary cylindrical outer surface; and (b) said second bridging portions joining said slip elements and said setting ring element are situated at the lower end of said slip elements and the upper end of said setting ring element.

33. The frac plug apparatus of claim 32, wherein said second bridging portions break generally along a plane coextensive with said cylindrical surfaces of said slip elements and said setting ring element.

34. The frac plug apparatus of claim 31, wherein said first bridging portions and said second bridging portions are offset radially from each other.

35. A method of setting a plug in a liner and isolating a downhole portion of said liner, said method comprising:

(a) running said plug into said liner to a location to be plugged, wherein said plug is in an unset state comprises a plug body;

(b) applying along a major axis of said plug body a first compressive force across a wedge element of said plug body and an array of slip elements of said plug body;

(c) breaking, by the application of said first compressive force, bridging portions of said plug body joining said wedge element and said slip elements;

(d) driving said wedge element into said slip elements to radially expand said slip elements into engagement with said liner and anchor said plug in said liner; and (e) deploying a frac ball onto a ball seat in a central bore of said wedge element to restrict downward flow of fluids through said central bore, wherein after said slip elements are driven into engagement with said liner, said ball seat is situated radially inward of said slip elements.

36. The method of claim 35, wherein said method comprises:

(a) applying along a major axis of said plug body a second compressive force across said slip elements and a setting ring element of said plug body;

(b) breaking, by the application of said second compressive force, second bridging portions of said plug body joining said slip elements and said setting ring element; and (c) driving said setting ring into abutment with said slip elements;

(d) applying said first compressive force to break said first bridging portions and drive said wedge element into said slip elements.

37. The method of claim 35, wherein said method comprises:

(a) applying said first compressive force to drive a first ramping surface of said wedge element into said slip elements;

(b) applying along a major axis of said plug a third compressive force across a seal ring and said wedge element, said seal ring being carried on a second ramping surface of said wedge element; and (c) driving said seal ring up said second ramping surface to radially expand said seal ring into engagement with said liner.

38. The method of claim 37, wherein said method comprises applying said third compressive force to break a backup ring carried on said second ramping surface downhole of said seal ring and then to drive said seal ring and said backup ring up said second ramping surface.

39. The method of claim 35, wherein said ball seat, after said slip elements are driven into engagement with said liner, is situated below the axial midpoint of said slip elements.

40. The method of claim 35, wherein said method comprises:

(a) pumping liquid into said liner to generate hydraulic pressure above said frac ball;

(b) applying said hydraulic pressure to a cup seal coupled to said plug body to generate radial load on said cup seal and press said cup seal into sealing engagement with said liner;

(c) wherein said hydraulic force is applied after said wedge element is driven into said slip elements.

41. The method of claim 40, wherein said method comprises:

(a) breaking, by the application of said hydraulic force, bridging portions of said plug body joining an array of seal backup elements of said plug body to said wedge element; and (b) radially expanding, by the application of said hydraulic force, a portion of said cup seal to shift said backup elements radially outward into engagement with said liner.

42. The method of claim 35, wherein said method comprises:

(a) applying said first compressive force to drive a first ramping surface of said wedge element into said slip elements;

(b) applying along a major axis of said plug a second compressive force across a thrust ring and said wedge element, said thrust ring abutting the upper end of said wedge element and abutting a cup seal carried on a second ramping surface of said wedge element;

(c) shearing, by the application of said second compressive force, said thrust ring;

(d) driving a sheared portion of said thrust ring across a portion of said wedge element, wherein said sheared portion of said thrust ring bears on said cup seal and drives said cup seal up said second ramping surface to radially expand said cup seal into engagement with said liner.

43. A frac plug apparatus, said plug comprising a plug body, wherein said plug body comprises:

(a) a central bore extending axially through said plug body; and (b) separable elements joined by relatively weak bridging portions adapted to break in a controlled manner, said separable elements thereby forming an integral component comprised of said separable elements, wherein said bridging portions comprise:

i) first bridging portions joining a first pair of said separable elements; and ii) second bridging portions joining a second pair of said separable elements;

iii) wherein said first and second bridging portions are offset radially from each other;

(c) whereby said plug is set i) by applying along a major axis of said plug body a first compressive force across said first bridging portions, said first compressive force being effective to break said first bridging portions; and ii) by applying along said major axis of said plug body a second compressive force across said second bridging portions, said second compressive force being effective to break said second bridging portions;

iii) wherein said first compressive force is greater than said second compressive force whereby said second bridging portions break before said first bridging portions break.

* * * * *